US009299553B2

(12) United States Patent
Whitehouse et al.

(10) Patent No.: US 9,299,553 B2
(45) Date of Patent: Mar. 29, 2016

(54) ATMOSPHERIC PRESSURE ION SOURCE FOR MASS SPECTROMETRY

(71) Applicants: PerkinElmer Health Sciences, Inc., Waltham, MA (US); Chem-Space Associates, Inc., Pittsburgh, PA (US)

(72) Inventors: Craig M. Whitehouse, Branford, CT (US); Thomas P. White, Clinton, CT (US); Ross C. Willoughby, Pittsburgh, PA (US); Edward William Sheehan, Pittsburgh, PA (US)

(73) Assignees: PerkinElmer Health Sciences, Inc., Waltham, MA (US); Chem-Space Associates, Inc., Pittsburgh, PA (US)

( * ) Notice: Subject to any disclaimer, the term of this patent is extended or adjusted under 35 U.S.C. 154(b) by 0 days.

(21) Appl. No.: 14/226,101

(22) Filed: Mar. 26, 2014

(65) Prior Publication Data

US 2014/0326871 A1 Nov. 6, 2014

Related U.S. Application Data

(60) Division of application No. 13/218,800, filed on Aug. 26, 2011, now Pat. No. 8,723,110, which is a continuation of application No. 12/368,712, filed on Feb. 10, 2009, now Pat. No. 8,080,783, which is a (Continued)

(51) Int. Cl.
*H01J 49/00* (2006.01)
*H01J 49/16* (2006.01)
(Continued)

(52) U.S. Cl.
CPC ..... *H01J 49/165* (2013.01); *H01J 49/0431* (2013.01); *H01J 49/107* (2013.01); *H01J 49/168* (2013.01); *H01J 49/26* (2013.01)

(58) Field of Classification Search
CPC ..... H01J 49/165; H01J 49/145; H01J 49/06; G01N 30/7266
USPC ..... 250/288, 282, 423 R, 424, 425
See application file for complete search history.

(56) References Cited

U.S. PATENT DOCUMENTS 4,318,028 A * 3/1982 Perel et al. ..... 315/111.81
4,542,293 A 9/1985 Fenn et al.
(Continued)

FOREIGN PATENT DOCUMENTS

WO WO 03/102537 12/2003

OTHER PUBLICATIONS

Amunugama et al., "Whole Protein Dissociation in a Quadrupole Ion Trap: Identification of an a Priori Unknown Modified Protein," Anal. Chem., 76(3):720-727, 2004.
(Continued)

*Primary Examiner* — Michael Maskell
(74) *Attorney, Agent, or Firm* — Fish & Richardson P.C.

(57) ABSTRACT

A multiple function atmospheric pressure ion source interfaced to a mass spectrometer comprises multiple liquid inlet probes configured such that the sprays from two or more probes intersect in a mixing region. Gas phase sample ions or neutral species generated in the spray of one probe can react with reagent gas ions generated from one or more other probes by such ionization methods as Electrospray, photoionization, corona discharge and glow discharge ionization. Reagent ions may be optimally selected to promote such processes as Atmospheric Pressure Chemical Ionization of neutral sample molecules, or charge reduction or electron transfer dissociation of multiply charged sample ions. Selected neutral reagent species can also be introduced into the mixing region to promote charge reduction of multiply charged sample ions through ion-neutral reactions. Different operating modes can be performed alternately or simultaneously, and can be rapidly turned on and off under manual or software control.

9 Claims, 13 Drawing Sheets

Related U.S. Application Data division of application No. 11/396,968, filed on Apr. 3, 2006, now abandoned.

(60) Provisional application No. 60/668,544, filed on Apr. 4, 2005.

(51) Int. Cl.

| | |
|---|---|
| ***H01J 49/04*** | (2006.01) |
| ***H01J 49/10*** | (2006.01) |
| ***H01J 49/26*** | (2006.01) |

(56) References Cited

U.S. PATENT DOCUMENTS

| | | | | |
|---|---|---|---|---|
| 5,247,842 | A | 9/1993 | Kaufman et al. | |
| 5,495,108 | A | 2/1996 | Apffel, Jr. et al. | |
| 5,668,370 | A * | 9/1997 | Yano et al. | 250/288 |
| 5,750,988 | A | 5/1998 | Apffel et al. | |
| 5,869,831 | A | 2/1999 | De La Mora et al. | |
| 6,107,628 | A | 8/2000 | Smith et al. | |
| 6,207,954 | B1 * | 3/2001 | Andrien et al. | 250/288 |
| 6,211,516 | B1 | 4/2001 | Syage et al. | |
| 6,294,779 | B1 | 9/2001 | Apffel et al. | |
| 6,350,617 | B1 * | 2/2002 | Hindsgaul et al. | 436/173 |
| 6,410,914 | B1 * | 6/2002 | Park et al. | 250/288 |
| 6,534,765 | B1 * | 3/2003 | Robb et al. | 250/288 |
| 6,541,768 | B2 * | 4/2003 | Andrien et al. | 250/288 |
| 6,646,255 | B2 | 11/2003 | Fukuda | |
| 6,646,257 | B1 * | 11/2003 | Fischer et al. | 250/288 |
| 6,649,907 | B2 * | 11/2003 | Ebeling et al. | 250/288 |
| 6,700,119 | B1 | 3/2004 | Giles | |
| 6,759,650 | B2 | 7/2004 | Covey et al. | |
| 6,828,551 | B2 * | 12/2004 | Kato | 250/281 |
| 6,914,240 | B2 * | 7/2005 | Giles et al. | 250/285 |
| 6,995,362 | B1 * | 2/2006 | Burke et al. | 250/288 |
| 7,034,291 | B1 | 4/2006 | Fischer et al. | |
| 7,078,681 | B2 | 7/2006 | Fischer et al. | |
| 7,109,476 | B2 * | 9/2006 | Hanold et al. | 250/288 |
| 7,217,921 | B2 | 5/2007 | Guevremont et al. | |
| 7,223,968 | B2 | 5/2007 | Fischer et al. | |
| 7,315,020 | B2 * | 1/2008 | Park et al. | 250/288 |
| 7,399,961 | B2 * | 7/2008 | Chen et al. | 250/288 |
| 7,411,186 | B2 * | 8/2008 | Mordehai | 250/288 |
| 7,417,226 | B2 * | 8/2008 | Bajic et al. | 250/288 |
| 7,488,953 | B2 | 2/2009 | Fischer et al. | |
| 7,812,308 | B2 | 10/2010 | Kobayashi | |
| 7,960,711 | B1 * | 6/2011 | Sheehan et al. | 250/493.1 |
| 7,982,185 | B2 * | 7/2011 | Whitehouse et al. | 250/288 |
| 8,080,783 | B2 | 12/2011 | Whitehouse et al. | |
| 8,723,110 | B2 | 5/2014 | Whitehouse et al. | |
| 2001/0013490 | A1 * | 8/2001 | Moon et al. | 210/198.3 |
| 2002/0096631 | A1 * | 7/2002 | Andrien et al. | 250/288 |
| 2002/0125423 | A1 * | 9/2002 | Ebeling et al. | 250/288 |
| 2003/0071209 | A1 | 4/2003 | Park et al. | |
| 2004/0041093 | A1 * | 3/2004 | Schultz et al. | 250/288 |
| 2004/0079881 | A1 * | 4/2004 | Fischer et al. | 250/288 |
| 2004/0089802 | A1 * | 5/2004 | Kato | 250/285 |
| 2004/0099803 | A1 * | 5/2004 | Tong et al. | 250/288 |
| 2004/0118953 | A1 | 6/2004 | Elrod et al. | |
| 2004/0206901 | A1 | 10/2004 | Chen et al. | |
| 2005/0056776 | A1 * | 3/2005 | Willoughby et al. | 250/281 |
| 2006/0131497 | A1 * | 6/2006 | Yang et al. | 250/288 |
| 2006/0255261 | A1 | 11/2006 | Whitehouse et al. | |
| 2007/0023675 | A1 * | 2/2007 | Fischer et al. | 250/423 P |
| 2007/0138406 | A1 * | 6/2007 | Mordehai | 250/426 |
| 2010/0096542 | A1 | 4/2010 | Whitehouse et al. | |

OTHER PUBLICATIONS

Andrien et al., "Multiple Inlet Probes for Electrospray and APCI Sources," Proceedings of the 46th ASMS Conference on Mass Spectrometry and Allied Topics, Orlando Fla. 1998, p. 889.

Balough, "Emerging Technologies in the MS Arsenal," LCG North America, 22(11):1082-1090, 2004.

Berkova et al., "Exploring Multiple Probe Techniques to Improve Mass Measurement Accuracy in Microbore ESI and APCI TOF LC-MS," poster No. 10, Montreux LC-MS Symposium, Montreux, Switzerland, 2004.

Cassidy et al., "Deprotonation Reactions of Multiply Protonated Ubiquitin Ions," Rapid Commun. Mass Spectrom., 8:394-400, 1994.

Coon et al., "Anion dependence in the partitioning between proton and electron transfer in ion/ion reactions," Int. J. Mass Spec., 236:33-42, 2004.

U.S. Appl. No. 60/573,666, filed May 21, 2004.

Engel et al., "Charge state dependent fragmentation of gaseous protein ions in a quadrupole ion trap: bovine ferri-, ferro-, and apocytochrome *c*," Int. J. Mass Spec., 219:171-187, 2002.

European Search Report, dated Mar. 29, 2012 for Application No. 06740350.1, 8 pages.

Gallagher et al., "Combined Electrospray Ionization-Atmospheric Pressure Chemical Ionization Source for Use in High-Throughput LC-MS Applications," J. Anal. Chem, 75(4):973-977, 2003.

Griffey et al., "Oligonucleotide Charge States in Negative Ionization Electrospray-Mass Spectrometry Are a Function of Solution Ammonium Ion Concentration," J. Am. Soc. Mass. Spec., 8:155-160, 1997.

He et al., "Dissociation of Multiple Protein Ion Charge States Following a Single Gas-Phase Purification and Concentration Procedure," Anal. Chem., 74(18):4653-4661, 2002.

Hogan et al., "Charge state dependent collision-induced dissociation of native and reduced porcine elastase," J. Mass Spec., 38:245-256, 2003.

Loo et al., "A New Approach for the Study of Gas-Phase Ion-Ion Reactions using Electrospray Ionization," J. Am. Soc. Mass Spectrom, 3:695-705, 1992.

Loo et al., "Investigation of the Gas-Phase Structure of Electrosprayed Proteins using Ion-Molecule Reactions," J. Am. Soc. Mass Spectrom, 5:207-220, 1994.

Loo et al., "Protein Structural Effects in Gas Phase Ion/Molecule Reactions with Diethylamine," Rapid Commun. Mass Spectrom, 6:159-165, 1992.

McLafferty et al, "Electron Capture Dissociation of Gaseous Multiply Charged Ions by Fournier-Transform Ion Cyclotron Resonance," J. Am. Soc. Mass Spectrom, 12:245-249, 2001.

McLuckey et al., "Charge Determination of Product Ions Formed from Collision-Induced Dissociation of Multiply Protonated Molecules via Ion/Molecule Reactions," J. Anal. Chem., 63:1971-1978, 1991.

McLuckey et al., "Ion Parking during Ion/Ion Reactions in Electrodynamic Ion Traps," Anal. Chem., 74(2):336-346, 2002.

McLuckey et al., "Ion/Ion Proton-Transfer Kinetics: Implications for Analysis of Ions Derived from Electrospray of Protein Mixtures," Anal. Chem., 70:1198-1202, 1998.

Reid et al., "Gas-Phase Concentration, Purification, and Identification of Whole Proteins from Complex Mixtures," J. Am. Chem. Soc., 124:7353-7362, 2002.

Reid et al., "Performance of a quadrupole ion trap mass spectrometer adapted for ion/ion reaction studies," Int. J. Mass Spec., 222:243-258, 2003.

Scalf et al., "Charge Reduction Electrospray Mass Spectrometry," Anal. Chem. 72(1):52-60, 2000.

Scalf et al., "Controlling Charge States of Large Ions," Science, 283:194-197, 1999.

Shen et al., "Dual Parallel Probes for Electrospray Sources," 47$^{th}$ ASMS Conference on MassSpectrometry and Allied Topics, 1999.

Shen et al., "Minimizing chemical Noise through Rational design of a 'Universal' API Source: A Comparative Study," p. 890 (Proceedings of the 46$^{th}$ ASMS Conference on Mass Spectrometry and Allied Topics, Orlando Fla. 1998).

Stephenson and McLuckey, "Adaptation of the Paul Trap for study of the reaction of multiply charged cations with singly charged anions," Int. J. of Mass Spec. and Ion Proc., 162:89-106, 1997.

(56) References Cited

OTHER PUBLICATIONS

Stephenson and McLuckey, "Simplification of Product Ion Spectra Derived from Multiply Charged Parent Ions via Ion/Ion Chemistry," Anal. Chem, 70:3533-3544, 1998.
Syage et al., "Atmospheric pressure photoionization II. Dual source ionization," J. Chromatogr. A 1050:137-149, 2004.
Syka et al., "Peptide and protein sequence analysis by electron transfer dissociation mass spectrometry," Proc. Natl. Acad. Sci. USA 2004, p. 1-11.
Wang and Cole, "Solution, Gas-Phase, and Instrumental Parameter Influences on Charge-State Distributions in Electrospray Ionization MassSpectrometry," Electrospray Ionization Mass Spectrometry: fundamentals, Instrumentation and Applications, edited by Richard Cole, John Wiley and sons, Inc. 1997, Chapter 4, 137-174.
Whitehouse et al., "Rapid API TOF State Switching with Fast LC-MS," 47$^{th}$ ASMS Conference on MassSpectrometry and Allied Topics, 1999.
Winger et al, "Observation and Implications of High Mass-to-Charge Ratio Ions from Electrospray Ionization Mass Spectrometry," J. Am. Soc. Mass Spectrom., 4:536-545, 1993.
Zubarev et al., "Electron Capture Dissociation of Multiply Charged Protein Cations. A Nonergodic Process," J. Am. Chem. Soc. 120:3265-3266, 1998.
Office Action issued in EP06740350.1 on May 22, 2015 (9 pages).
Office Action issued in CA2,603,888 on May 26, 2015 (5 pages).

* cited by examiner

ATMOSPHERIC PRESSURE ION SOURCE FOR MASS SPECTROMETRY

RELATED APPLICATIONS

This application is a continuation of U.S. application Ser. No. 13/218,800, filed Aug. 26, 2011, which is a continuation of U.S. application Ser. No. 12/368,712, filed Feb. 10, 2009, which is a divisional of U.S. application Ser. No. 11/396,968, filed on Apr. 3, 2006, which claims the benefit of Provisional Patent Application No. 60/668,544, filed on Apr. 4, 2005.

FIELD OF INVENTION

The invention relates to the production of ion populations at atmospheric pressure for subsequent Mass Spectrometric analysis of chemical, biological, medical and environmental samples.

BACKGROUND

Mass spectrometer (MS) development and operation have consistently been directed to increasing analytical capability and performance while reducing complexity, unit cost and size. As mass spectrometry is applied to an increasing range of applications, it is desirable to increase the analytical capability of a mass spectrometer while minimizing the complexity of hardware and operation. A multiple function atmospheric pressure ion source that minimizes or eliminates hardware changes while allowing user selected software switching between different but complimentary operating modes, increases MS analytical capability and reduces the operating complexity of MS acquisition. The analytical capability of MS analysis increases with a multiple ionization mode source that allows detection of both polar and non polar compounds contained in liquid and solid samples. The invention combines Electrospray (ES) ionization, Atmospheric Pressure Chemical Ionization (APCI), Atmospheric Pressure Photoionization (APPI) and ionization of samples from surfaces and additional functions in one Atmospheric Pressure Ion (API) source with the capability to run such operating modes individually or in combination. Additional functions supported by the multiple function API source configured and operated according to the invention include charge reduction of multiply charged ions, Electron Transfer Dissociation (ETD) and the generation of calibration ions independent of the sample solution. Mass spectrometers interfaced to atmospheric pressure ion sources have been employed extensively in chemical analysis including environmental applications, pharmaceutical drug development, proteomics, metabolomics and clinical medicine applications. In combinatorial chemistry or high throughput biological screening applications, mass spectrometry is used to qualify purity of compound libraries prior to screening for a potential drug candidate as well as the detection of screening results. The invention increases the analytical capability of MS analysis for a wide range of applications while reducing the time, cost and complexity of analysis.

Multiple Sprayer ES Sources

An increasing number of multiple operating mode atmospheric pressure ion sources for mass spectrometry have become available on commercial instrumentation. Analytica of Branford, Inc. introduced the first multiple Electrospray probe source that allowed the spraying of different solutions individually or simultaneously with common sampling of ions through an orifice into vacuum for MS analysis as described in U.S. Pat. Nos. 6,541,768 B2 and 6,541,768 and by Andrien, B. A., Whitehouse, C. and Sansone, M. A. "Multiple Inlet Probes for Electrospray and APCI Sources" p. 889 and Shen, S., Andrien, B., Sansone, M. and Whitehouse, C., "Minimizing Chemical Noise through Rational Design of a 'Universal' API Source: A Comparative Study", p. 890, Proceedings of the 46th ASMS Conference on Mass Spectrometry and Allied Topics, Orlando Fla., 1998, Whitehouse, C. M.; Gulcicek, E.; Andrien, B. and Shen, S.; "Rapid API TOF state Switching with Fast LC-MS" and Shen, S.; Andrien, B. A.; Sansone, M. and Whitehouse, C. M.; "Dual Parallel Probes for Electrospray Sources"; 47th ASMS Conference on Mass Spectrometry and Allied Topics, 1999 and Berkova, M., Russon, L., Shen, S. and Whitehouse, C. M., "Exploring Multiple Probe Techniques to Improve Mass Measurement Accuracy in Microbore ESI and APCI TOF LC-MS", poster number 10, Montreux LC-MS Symposium, Montreux, Switzerland, 2004. Multiple inlet probes configured to operate alternately or simultaneously in one API source allows the generation of ions from multiple sample solutions or calibration solutions introduced alternately or simultaneously through the multiple inlet probes. Gas phase ion populations produced from different inlet probes can be mixed at atmospheric pressure prior to sampling the mixed ion population into vacuum for mass to charge analysis. Ions generated from one inlet probe can be sampled into vacuum to provide internal or external MS calibration without mixing with or contaminating a sample solution introduced through another sample solution inlet probe. In one of Analytica of Branford's multiprobe ES source products, two independent Electrospray probes are configured in parallel with the ability to change the ion ratio mixture sampled from the two liquid inlet probes by changing solution concentration, liquid flow rate or small adjustments to the probe positions relative to the orifice into vacuum. Calibration ion generation can be switched on and off in sub second time frames by turning off nebulization gas and/or calibration sample liquid flow before, after or during LC runs to selectively introduce calibration peaks into acquired mass spectra. Analytica's ES and corona discharge APCI multiple probe atmospheric pressure ion sources allow the individual or simultaneous spraying from multiple solution inlet probes with individual or combined sampling of ions into vacuum. No mechanical adjustment of hardware components is required for switching between multiple functions in the Analytica API sources during MS data acquisition.

Multiple Electrospray probe ion sources were subsequently introduced as product by Micromass ("MUX-Technology™") in which a rotating baffle was positioned between the simultaneously spraying ES probes and the orifice into vacuum. The multiple ES sprays and the ion populations produced from the multiple sprays do not intersect and the baffle allows only one ES spray at a time to deliver ions to the orifice into vacuum. In one operating configuration, multiple outputs of LC columns are sprayed simultaneously from individual pneumatic nebulization assist ES probes into a common ES source chamber. The rotating baffle allows one spray at a time to deliver ions into the orifice to vacuum while blocking the remaining sprays. Each LC column outlet can be sampled in a multiplexed fashion with acquired spectra sorted by LC column sampling order. The detection duty cycle for each LC column output is reduced by the number of ES probes spraying simultaneously (up to 8 ES sprays) but does allow acquisition by a single Mass Spectrometer from multiple parallel LC separations. The trade off is reduced LC-MS system price (multiple parallel LC separations with one MS detector) at the cost of reduced duty cycle and reduced data point density per LC chromatogram. Micromass has introduced a variation of the multiplexed sampling ES source (called "MUX-technology-Exact Mass") in which two ES probes are configured to spray simultaneously where one spray introduces sample solution and the second spray introduces a reference or calibration solution. A rotating baffle prevents the two ES sprays from intersecting or mixing and allows only one spray at a time to deliver ions to the orifice to vacuum. The ES spray from the opposite probe is blocked. In this dual probe Electrospray ion source, calibration ions can be switched to enter vacuum during acquisition but not simultaneously with analyte ions to provide calibration reference peaks. Switching the rotating baffle to sample the calibration solution ES spray reduces the duty cycle of MS acquisition from the analyte ES sprayer. In the Micromass (currently part of Waters Corporation) API products, ions of the same polarity generated from multiple inlet Electrospray probes are sampled from each inlet probe individually into vacuum for MS analysis but are configured to prevent mixing of ion or neutral molecule populations generated from different inlet probes.

Multiple Inlet APCI Sources

Simultaneously with the multiple ES probe ion source, Analytica introduced multiple sample inlet probe corona discharge APCI source described in the references given above. This multiple inlet probe APCI source allowed the introduction of different sample solutions through separate inlet nebulizers with corona discharge Atmospheric Pressure Chemical Ionization. In one operating mode, the analyte sample solution is introduced through a first pneumatic nebulizer probe and calibration sample is introduced through a second pneumatic nebulizer probe. The calibration solution flow can be rapidly turned on or off during acquisition to provide internal or external calibration in acquired MS spectra. When the two solutions are sprayed simultaneously, the samples are mixed and vaporized in a common flow through the ACPI vaporizer heater, pass through a corona discharge and are ionized.

Combination ES and APCI Sources

Along with multiple inlet ES and APCI sources, Analytica developed combination ES and APCI sources where separate ES and APCI probes can be operated separately in time or simultaneously as described in U.S. Pat. Nos. 6,541,768 B2 and 6,541,768. The ES and APCI probes were configured with separate liquid sample inlets and the ion populations produced from each probe could be mixed prior to passing through the orifice into vacuum for MS analysis. In the Analytica combination source, Electrospray plumes intersected the corona discharge region of the APCI probe and vaporizer when both inlet probes were operated simultaneously. No mechanical movement of ES or APCI probes was required when switching to ES, APCI or combined operating modes. Recently, Agilent and Waters (Micromass) have introduced combination ES and APCI sources configured with a single pneumatic nebulizer inlet probe configured to allow ES or corona discharge APCI ion generation as reported by Balough, M. P. LCG North America, Vol. 22, No. 11, 2004, 1082-1090 and Gallagher, R. T., Balough, M. P., Davey, P., Jackson, M. R., Sinclair, I. and Southern, L. J. Anal. Chem, 75, 973-977. Both combination source versions employ a corona discharge but the traditional dedicated APCI vaporizer heater has been eliminated. Agilent has added infrared heaters surrounding the nebulized ES spray to cause vaporization of the sample and Micromass has added an additional heated gas flow surrounding the ES probe to aid in evaporating the sprayed liquid droplets. The surrounding electrostatic lenses in the Agilent combination ion source allow a portion of the ES ions to reach the orifice into vacuum even while the corona discharge is turned on simultaneously producing ions through gas phase chemical ionization reactions. The Waters combination ES and APCI ion source, named the "ESCi™Multi-Mode Ionization Source" and described in International Patent Application Publication Number WO 03/102537 A2, operates by alternately and rapidly switching high voltage between the pneumatic nebulization assisted Electrospray tip and the corona discharge needle positioned in the path of the same pneumatic nebulized spray, allowing sequential sampling of ES and APCI generated ions into the orifice into vacuum. The sampling duty cycle between APCI and ES operation can be controlled by changing the duration of voltage applied alternately to the nebulizer tip (ES operation) and the corona discharge needle. Individual MS spectra are acquired in either ES or APCI operating modes using this Waters combination API source; however, the ES and APCI operating modes can not be run simultaneously.

The combination ions sources described above each have some loss in ES or APCI signal or duty cycle when run in combination compared with operation in ES or APCI only modes. However, the ability to rapidly switch between ionization modes increases analytical capability for a given sample inlet without the need to change hardware from one ion source type to another. The earlier Analytica multiple inlet ion source supports selective ES and APCI ionization of a sample solution. The Analytica multiple inlet probe ES and APCI source supports the splitting of LC output to both the ES and APCI inlet probes allowing sequential or simultaneous ES and APCI ion generation by switching corona discharge needle voltage on or off. The Analytica combination ES and APCI source also allows the introduction of two independent sample solutions, through the ES and APCI inlet probes respectively, allowing the gas phase mixing of ion populations from different solution compositions and ionization modes. Agilent and Waters combination ES and APCI sources are configured with a single sample inlet probe. Neither allows the capability to generate a population of ions from a second inlet probe to provide a second population of gas phase reagent ions or reference ions for MS calibration during MS spectrum acquisition.

Charge Reduction of Multiply Charged Ions at Atmospheric Pressure

Charge reduction of multiply charged ions generated in Electrospray MS has been accomplished using several methods. These include:

(a) changing the composition of solutions being Electrosprayed as described by Wang, G., and Cole, R. B., "Solution, Gas-Phase, and Instrumental Parameter Influences on Charge-State Distributions in Electrospray Ionization Mass Spectrometry", Electrospray Ionization Mass Spectrometry: Fundamentals, Instrumentation and Applications, edited by Richard Cole, John Wiley and Sons, Inc., 1997, Chapter 4, 137-174; Winger, B. E., Light-Wahl, K. J., Ogorzalek Loo, R. R., Udseth, H. R., and Smith, R. D., J. Am. Soc. Mass Spectrom 1993, 4, 536,-545 and Griffey, R. H.; Sasmor, H. and Grieg, M. J.; J. Am. Soc. Mass Spectrom 1997, 8, 155-160;

(b) reacting positive polarity multiply charged ions with basic (deprotonating) neutral molecules in vacuum or partial vacuum as reported by Cassidy, C. J., Wronka, J., Kruppa, G. H., and Laukien, F. H., Rapid Commun. Mass Spectrom., 8, 394-400, (1994); Ogorzalek Loo, R. R., Smith, R. D., J. Am. Soc. Mass Spectrom., 1994, 5, 207-220 and McLuckey, S. A., Glish. G. L. and Van Berkel, G. J. Anal. Chem. 1991, 63, 1971-1978;

(c) charge stripping with Collision Induced Dissociation (CID) in vacuum or partial vacuum;

(d) reacting of multiply charged ions with ions of opposite polarity in ion traps in vacuum as reported by McLuckey, S. A., Stephenson, J. L., Asano, K. G., Anal. Chem. 1998, 70, 1198-1202; Stephenson J. L., McLuckey, S. A., International Journal of Mass Spec. and Ion Processes, 162, 1997, 89-106; Stephenson, J. L., McLuckey, S. A., Anal. Chem, 1998, 70, 3533-3544; McLuckey, S. A., Reid, G. E., Wells, J. M., Anal. Chem., 2002, 74, 336-346; Reid, G. E., Shang, H., Hogan, J. M., Lee, G. U., McLuckey, S. A., J. Am. Chem. Soc., 2002, 124, 7353-7362; Engel, B. J., Pan., P., Reid, G. E., Wells, J. M., McLuckey, S. A., Int. Journal Mass Spec., 219, 2002, 171-187; Reid, G. E., Wells, J. M., Badman, E. R., McLuckey, S. A., Int. Journal Mass Spec., 222, 2003, 243-258; He, M., Reid, G. E., Shang, H., Lee, G. U., McLuckey, S. A., Anal. Chem. 2002, 74, 4653-4661; Hogan, J. M., McLuckey, S. A., Journal of Mass Spec., 2003, 38, 245-256 and Amunugama, R., Hogan, J. M., Newton, K. A., and McLuckey, S. A., Anal Chem. 2004, 76, 720-727;

(e) reaction of multiply charged ions with ions of the opposite polarity in partial vacuum pressure as reported by Ogorzalek Loo, R. R., Udseth, H. R. and Smith, R. D., J. Am. Soc. Mass Spectrom 1992, 3, 695-705 and Ogorzalek Loo, R. R., Lao, J. A., Udseth, H. R., Fulton, J. L. and Smith, R. D. Rapid Commun. Mass Spectrom. 1992, 6, 159-165; and (f) reaction of multiply charged ions with ions of the opposite polarity at atmospheric pressure as described by U.S. Pat. No. 5,247,842; Scalf, M.; Westphall, M. S.; Krause, J.; Kaufman, S. L. and Smith, L. M.; Science, Vol. 283, Jan. 8, 1999, 194-197; Scalf, M.; Westphall, M. S.; and Smith, L. M.; Anal. Chem. 2000, 72, 52-60 and U.S. Patent Number; U.S. Pat. No. 6,649,907 B2.

None of the techniques to effect charge reduction of multiply charged ions reported above cause reduction of the charge state of multiply charged ions at atmospheric pressure by mixing ions or neutral species in the gas phase produced from different liquid sample or gas inlets as is described in the present invention.

Electron Transfer Dissociation of Multiply Charged Ions

Electron Capture Dissociation (ECD), first reported by McLafferty and co-workers, Zubarev, R. A.; Kelleher, F. W. and McLafferty, F. W.; J. Am. Chem. Soc. 120 (1998) 3265-3266 and McLafferty, F. W.; Horn, D. M.; Breuder, K.; Ge, Y.; Lewis, M. A.; Cerda, B.; Zubarev, R. A. and Carpenter, B. K.; J. Am. Soc. Mass Spectrom. 12 (2001) 245-249, has shown great promise as a highly complementary ion fragmentation method in protein and peptide research. The ability of low energy electron capture (<10 eV) to dissociate proteins and peptides along the amino acid backbone (breaking the amide nitrogen-alpha carbon bond), producing c and z type fragment ions while retaining intact function groups and side chains, has greatly aided research in protein structure and function. ECD has been conducted exclusively in high vacuum and costly Fourier Transform Mass Spectrometers. Recently, Coon and coworkers, Coon, J. J.; Syka, J. E. P.; Schwartz, J. C.; Shabanowitz, J. and Hunt, D. F.; Int. J. of Mass Spectrom. 236 (2004) 33-42 and Syka, J. E. P.; Coon, J. J.; Schroeder, M. J.; Shabanowitz, J. and Hunt, D. F.; Proc. Natl. acad. Sci. USA (2004), reported an analog to ECD termed Electron Transfer Dissociation (ETD) conducted in a modified linear ion trap. Radical anions and multiply charged proteins or peptides were added separately and trapped in a linear ion trap modified to trap positive and negative polarity ions simultaneously in a background pressure of approximately 3 millitorr. In the ETD process, ion-ion reactions occur whereby an anion transfers an electron to a positive polarity multiply charged peptide or protein with sufficient energy to cause rearrangement of a hydrogen radical leading to fragmentation of the protein or peptide backbone. This fragmentation pathway produces c and z type fragment ions that may remain noncovalently bound but can be dissociated in collisions with neutral background gas. By judicious selection of anion species coupled with an anion isolation step prior to ion-ion reaction, Coon and coworkers found that ETD could be enhanced over charge reduction processes. Although ETD has been reported by Coon and coworkers in a linear ion trap in partial vacuum, ETD has not been practiced in an atmospheric pressure ion source as described in the current invention.

Photoionization Combination Ion Sources

Photoionization has been conducted at atmospheric pressure, U.S. Patent Number; U.S. Pat. No. 6,534,765 B1, and in vacuum U.S. Patent Number; U.S. Pat. No. 6,211,516 B1 Bruins and coinventors added toluene dopant through a pneumatic nebulizer with vaporizer heater sample inlet probe at atmospheric pressure to enhance the photoionization signal of positive polarity protonated and radical cation species. Bruins et al does not describe the addition of photoionized reagent ions produced from a separate inlet probe and mixed with gas phase molecules produced from a separate sample inlet probe to generate sample ions. The API source configured and operated according to the invention allows the separate production of photoionized reagent ions from one liquid or gas inlet with mixing of such reagent ions with sample gas phase molecules produced from a sample solution inlet probe to generate ions from the evaporated sample solution. Syagen has developed a commercially available combination APCI and Atmospheric Pressure Photoionization Source (APPI) and a Combination ES and APPI source as described in Syage, J. A. et. al., J. Chromatogr. A 1050 (2004) 137-149. The krypton discharge uv lamp and/or a corona discharge needle configured in the Syagen ion sources is used to ionize gas phase neutral sample and reagent molecules produced from the same pneumatic nebulizer vaporizer heater inlet probe. In the combination ion sources described, photoionization is conducted directly on the primary sample solution sprayed and vaporized.

SUMMARY OF INVENTION

The invention comprises an Atmospheric Pressure Ion source that is configured to conduct multiple operating modes with rapid switching between operating modes manually or under software control and without the need to exchange hardware components. The ion source configured and operated according to the invention supports the following functions individually or simultaneously;

1. Electrospray ionization of a sample solution,

2. Atmospheric Pressure Chemical Ionization of a sample solution with corona discharge generated reagent ions, 3. Atmospheric Pressure Chemical Ionization of a sample solution with photoionization generated reagent ions, 4. The gas phase addition of a second population of ions to the sample generated ions for internal or external calibration of acquired mass spectra, 5. Charge reduction of Electrospray produced multiply charged ions through gas phase ion to molecule reactions at atmospheric pressure, 6. Charge reduction of Electrospray produced multiply charged ions through gas phase reactions with ions of opposite polarity at atmospheric pressure, 7. Reacting positive multiply charged ions produced from Electrospray ionization with negative polarity reagent ions at atmospheric pressure to cause Electron Transfer Dissociation of multiply charged ions at atmospheric pressure and 8. Ionizing samples from sample bearing surfaces at atmospheric pressure.

The invention comprises a multiple function atmospheric pressure ion source interfaced to a mass spectrometer. The multiple functions combined in one atmospheric pressure ion source serve to increase the overall mass analyzer capability and performance. Multiple ion source functions improve the analytical specificity and increase the speed and range of MS analysis for a wide range of analytical applications while lowering the cost of analysis. According to the invention, multiple inlet probes are configured in a multiple function API ion source and may be run individually or combined to provide different ion source operating modes with no increase in hardware complexity. The invention allows rapid switching between multiple ionization and gas phase ion-neutral or ion-ion reaction modes in offline or on-line operation. The multiple ion source functions can be complemented with further $MS^n$ analysis using an appropriate mass spectrometer that conducts one or more ion mass to charge selection and fragmentation steps. The multiple function ion source includes the ability to selectively generate ions through Electrospray ionization processes, Atmospheric Chemical Ionization Processes Photoionization processes and surface ionization processes individually or in combination. The multiple inlet probe ion source configured and operated according to the invention also enables the selective generation of calibration ions from one or more solution inlet probes that can be sampled separately or mixed with ions generated from a sample introduction probe during MS spectrum acquisition.

An API source configured according to the invention also allows the generation of ions from at least one additional liquid inlet probe having the opposite polarity from those ions generated from the sample introduction Electrospray probe. The opposite polarity ions from both inlet probes mix at atmospheric pressure allowing opposite polarity ion to ion reactions. In this manner, charge reduction or Electron Transfer Dissociation fragmentation of multiply charged ions generated from the primary Electrospray inlet probe can be selected as individual or combined operating modes. Alternatively, selected neutral gas species may be introduced with the countercurrent drying gas or through an additional inlet probe to mix with the multiply charged ions generated from the Electrospray sample inlet probe. Ion to neutral reactions resulting in proton transfer to and from negative or positive polarity multiply charged ions respectively result in charge reduction of multiply charged ions at atmospheric pressure. Charge reduction of multiply charged ions, particularly of mixtures, spreads mass spectral peaks out along the measured mass to charge scale by moving multiply charged ion peaks further up the mass to charge scale and reduces the number of redundant multiply charged peaks for each molecular species appearing in the mass spectrum. Spreading the mass spectra peaks over a larger mass to charge range and reducing the number of multiply charged peaks per molecular species reduces mass spectrum complexity. Reduced mass spectrum complexity facilitates interpretation of mass spectra and effectively increases peak capacity by expanding the mass to charge scale and reducing the number of overlapping peaks. A sample solution containing proteins or peptides Electrosprayed from the sample introduction probe into the multiple function API source produces positive polarity multiply charged ions. Negative polarity reagent ions of selected species produced from a second solution inlet probe spray can be mixed and reacted with the positive polarity multiply charged sample ions at atmospheric pressure resulting in Electron Transfer Dissociation of protein and peptide ions prior to MS analysis. Conducting a protein or peptide ion fragmentation step in the API source can be applied in a "top down" or "bottom up" approach for protein or peptide identification. Ion source ETD can be further complemented by additional $MS^n$ fragmentation steps conducted in the mass analyzer, enhancing specificity.

Multiple modes of API source ion generation and ion reactions can be switched on and off rapidly to create and analyze different ion populations from the same sample on-line and in real time or off-line in batch sample analysis. Ion populations produced in the multiple function API source can be further subjected to capillary to skimmer fragmentation and/or $MS^n$ fragmentation in the mass analyzer providing information rich data sets. Particularly in target analysis, such data sets can be applied to a range of automated data evaluation functions providing answers to the analytical questions posed. Ion source operating modes can be rapidly switched using preprogrammed acquisition methods or based on data dependent decisions. Individual and combined Electrospray, APCI, APPI operating modes, according to the invention, allow quantitative analysis with minimum compromise in a linear dynamic range when compared to single ionization mode ion source performance. All proposed API source operating modes can be controlled and/or switched through software with no change of hardware or reconnections to external fluid delivery systems.

In previously reported and commercially available single probe ES, APCI and combination ES and APCI sources, sample ions and reagent ions are generated from the same sample bearing solution. APCI reagent ions are generated using a corona discharge in single function APCI source or combination ES and APCI sources. The same solution that may optimize an LC separation or Electrospray ionization performance may not be the optimal solution for generating APCI or APPI reagent ions to maximize gas phase charge exchange efficiency or ionization of non polar and low proton affinity vaporized sample molecules. The API source configured according to the invention with multiple inlet probes allows the optimization of solution chemistries for front end sample separation and/or ES ionization of the sample flow through the sample solution inlet probe while allowing independent optimization of reagent ions or neutral gas reactant species introduced through additional inlet probes. Additional solution and gas inlet probes comprising in the ion source, configured according to the invention, allow the independent introduction of separate solution chemistries that are vaporized and/or ionized to provide optimal calibration ion species or gas phase ion or neutral reactions species when reacted with the sample introduction spray. Mixing two gas and ion populations generated from separate inlet probes can be optimized to enhance individual or combined ES, APCI or APPI ion generation from sample solution Electrosprayed or nebulized as a neutral spray. When operating multiple inlet probes to produce the same polarity ions, the reagent ions generated from the non sample inlet probes mix with gas phase ions and neutral molecules generated from the sample solution nebulized or Electrosprayed (with nebulization assist) from the primary sample inlet probe to promote gas phase ionization of the vaporized sample solution. By introducing reference standards to a second inlet probe solution, calibration ions can be generated simultaneously with reagent ions and mixed with the primary sample solution ions generated from the first inlet probe. This allows the selective introduction of calibration ions for internal or external calibration as well as enhancing gas phase ionization of less polar compounds independent from the sample solution introduction and ionization. The calibration sample solution is not introduced through the primary sample solution flow channel eliminating contamination or carry over issues.

Varying the neutral reagent molecule concentration and basicity can improve control of deprotonation of multiply charged species in the multiple inlet probe API source configured according to the invention while minimizing ion neutralization and reagent molecule clustering. Selected reagent species can be introduced as neutral gas phase molecules mixed with the countercurrent drying gas, by spraying through a second ES inlet probe with no electric field applied at the tip, by vaporizing a solution traversing the vaporizer of a second APCI inlet probe with no corona discharge applied to the exiting neutral vapor, or by adding reagent gas through the second probe nebulizer gas line. The gas phase reagent molecules introduced through the second inlet probe, or introduced with the countercurrent drying gas, mix with the multiply charged ions produced from sample introduction Electrospray probe. The ability to deprotonate a positive polarity multiply charged ion will be a function of gas phase reagent molecule basicity and the gas phase proton affinity of protonated sites on the multiply charged ions. Desired deprotonated charge states can be achieved with selection of specific reagent molecule gas phase basicity in target analysis. Charge reduction with multiply charged negative ions can also be achieved in the multiple function API source configured according to the invention by introducing neutral gas species with sufficiently high acidity. In atmospheric pressure ion-molecule reactions, the acidic reagent molecule may donate a proton to deprotonated sites of multiply charged negative ions such as oligonucleotides resulting in controlled charge reduction without neutralization.

In one embodiment of the invention, the API source comprises at least two Electrospray sample introduction probes configured with pneumatic nebulization assist and electrodes surrounding each Electrospray probe tip. The two ES inlet probes are configured so that the pneumatically nebulized spray plumes generated from each inlet probe intersect to form a mixing region. A portion of the ions generated from either inlet probe individually or generated in the mixing region are sampled through an orifice into vacuum and mass to charge analyzed. One ES inlet probe can be configured to serve as the primary sample introduction probe and the second ES inlet probe may be operated to provide an optimal reagent ion population in the mixing region to maximize atmospheric pressure chemical ionization of neutral gas molecules generated by evaporation of the sample solution Electrosprayed or nebulized from the sample inlet probe. APCI of neutral species is performed in the mixing region without the ion and neutral molecule population generated from the sample inlet probe traversing a corona discharge region. The second inlet probe spray can be turned off allowing the production of Electrospray-only generated ions from the sample solution. Conversely, voltage can be applied to the electrode surrounding the sample introduction inlet probe to minimize the production of Electrosprayed charged droplets producing a net neutral nebulized spray. The evaporating net neutral spray is then reacted with reagent ions generated from one or more additional ES inlet probes in the mixing region to produce an APCI ion population from the sample solution. With multiple inlet probes producing charged species, ES and APCI ions generated simultaneously from the sample solution can be sampled from the mixing region into vacuum for mass to charge analysis.

In an alternative embodiment of the invention, the additional inlet Electrospray probes are replaced with one or more APCI inlet probes comprising a pneumatic nebulizer, vaporizer heater and a corona discharge needle. The one or multiple additional APCI probe positions are configured to optimize the mixing of reagent ions and neutral gas species generated in the APCI vaporizer and corona discharge regions with the sample inlet probe spray. Similar to the multiple Electrospray inlet probe embodiment, the sample introduction ES probe and additional APCI probe embodiment can be operated to generate ES or APCI only ion populations, or mixtures of both, that are directed into vacuum for mass to charge analysis. In an alternative embodiment, an additional APCI probe comprises an ultraviolet light source to enable production of a photoionized reagent ion population that is directed into the mixing region. The invention includes the selective generation of reagent gas phase ions and neutral species by Electrospray, Corona Discharge or Photoionization independent from the population of ion and neutral gas phase species generated from the sample introduction probe. Sample neutral molecule and ion populations mix with the independently generated reagent ion and neutral gas populations to produce selected ES and APCI ion species that are directed into vacuum for mass to charge analysis.

In an alternative embodiment of the invention, selected gas neutral or opposite polarity ion species can be mixed with the ES generated sample spray to cause charge reduction or to effect atmospheric pressure Electron Capture Dissociation of multiple charged ions generated from the sample inlet ES probe. Neutral gas species can be introduced by mixing reagent molecule species with the countercurrent drying gas or with the non sample inlet probe nebulizer gas. Alternatively, reagent molecules can be produced from solution vaporized through introduction from a non sample inlet probe. In an alternative embodiment according to the invention, a second ES, APCI or APPI inlet probe can be operated to produce ions of opposite polarity from those ions generated from the sample introduction ES probe. The simultaneously produced opposite polarity ion populations are combined in a mixing region at atmospheric pressure. Reacting ions of opposite polarity with multiply charged ions generated from the ES sample inlet probe can result in charge reduction of the initial ES generated ion population at atmospheric pressure.

In one embodiment of the invention, at least one non-sample solution inlet probe produces a gas phase ion population that is directed to impinge on a sample bearing surface. The ions impacting on the sample bearing surface aid in the evaporation and ionization of the sample on the surface when combined with rapidly switching of the electric field at the surface with or without a laser desorption pulse.

In all embodiments of the invention, populations of ions can be generated from one or more sample inlet probes where they may be directed into vacuum for mass to charge analysis, mixed with other ion populations simultaneously generated at or near atmospheric pressure prior to sampling into vacuum for mass to charge analysis, or reacted with independently generated ion or neutral species at or near atmospheric pressure followed by mass to charge analysis of the product ion population. Calibration ions generated from solutions introduced through non-sample inlet probes can be mixed with sample-generated ions prior to mass to charge analysis to provide calibration peaks in an acquired mass spectrum. Alternatively, the calibration ions can be mass to charge analyzed, not mixed with sample related ions, to provide mass spectra that can be used for external calibration. All modes of API source operation, according to the invention, can be rapidly switched on or off through event-dependent program control, or preprogrammed or user interactive software control.

BRIEF DESCRIPTION OF FIGURES

FIG. 13 is curve showing the mass spectrum signal of Indole Electrosprayed into an API source configured similar to that diagramed in FIG. 1 with and without the second Electrospray probe turned on.

DETAILED DESCRIPTION OF THE INVENTION

Figure 1:
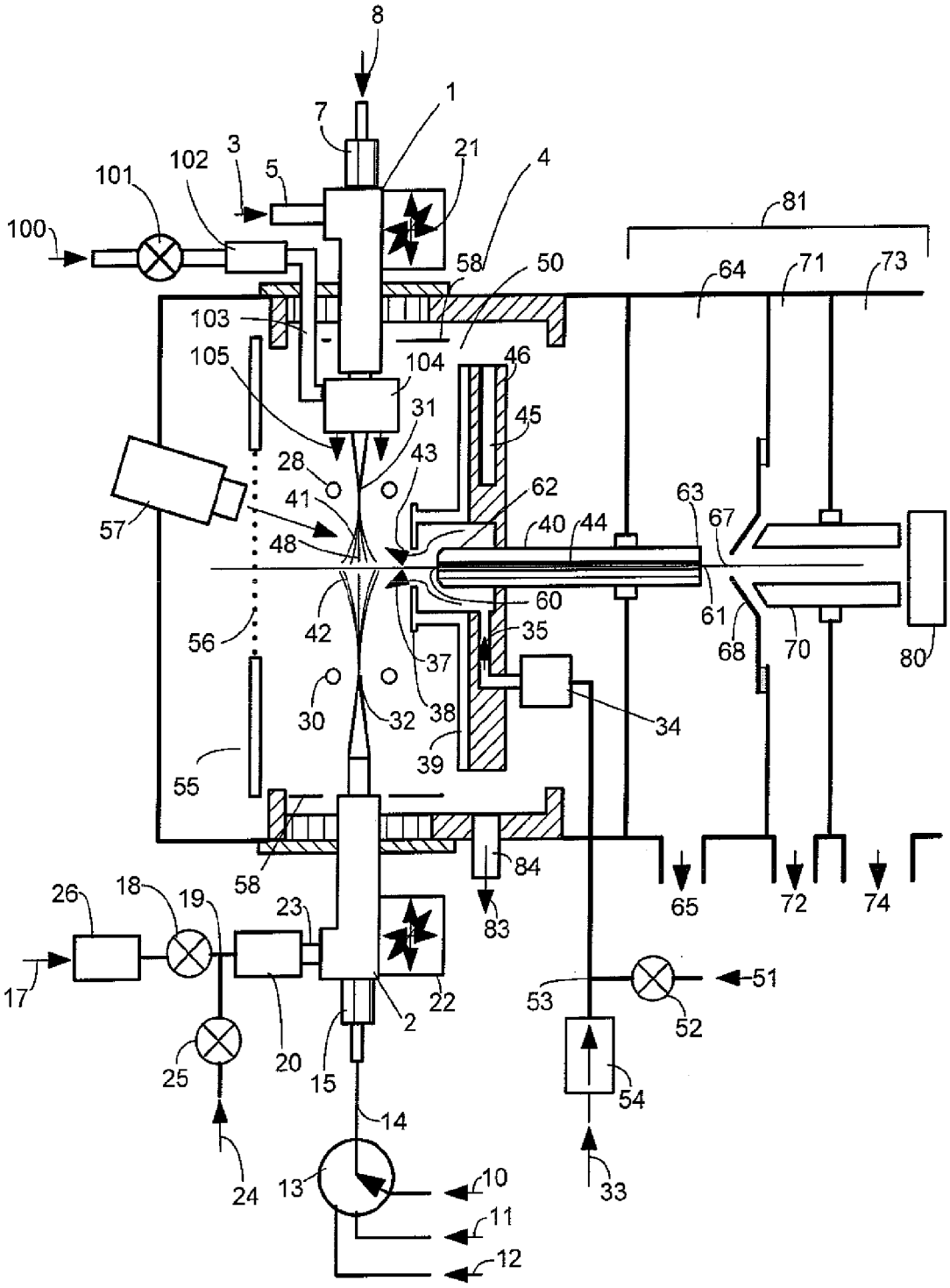
FIG. 1 is a diagram of an Electrospray ion source including two Electrospray liquid inlet probes configured to spray in opposite directions with an intersecting spray region.

One embodiment of the invention as diagramed in FIG. 1, comprises two Electrospray sample introduction probes configured in an Atmospheric Pressure Ion source interfaced to a mass spectrometer. Multiple inlet probe API source 4 comprises Electrospray inlet probe 1 and Electrospray inlet probe 2. Sample solution 8 is introduced through liquid inlet port 7 into Electrospray sample inlet probe 1. Nebulization gas 3 is introduced into Electrospray probe 1 through channel 5. ES inlet probe 1 drying gas 100 passes through flow control valve 101, heater 102, channel 103 and exits through gas distribution collar 104 as heated drying gas 105 flowing coaxially in the direction of Electrospray plume 41. Infrared lamp 57 may be turned on to provide additional enthalpy to aid in the evaporation of liquid droplets in Electrospray plume 41. One or more infrared lamps 57 may be configured in ion source chamber 50 and operated with or without auxiliary drying gas 105 to promote the drying of liquid droplets in Electrospray plume 41. Different reagent, calibration or sample liquids can be selected through channels 10, 11 and 12 using valve 13. Reagent solutions Electrosprayed from ES inlet probe 2 may comprise very clean pure solvents or solvent mixtures. The selected solution passes through channel 14 and port 15 into Electrospray inlet probe 2. Nebulization gas 17 passes through pressure regulator 26, valve 18, junction 19, gas heater 20 and channel 23 into Electrospray inlet probe 2. Auxiliary gas 24 can be added to nebulizer gas 17 through valve 25. The positions of Electrospray inlet probes 1 and 2 can be adjusted using translator stages 21 and 22 respectively with manual or software control. Ring or cylindrical electrostatic lens 28 surrounds exit end 31 of Electrospray inlet probe 1. Similarly, ring or cylindrical electrostatic lens 30 surrounds exit end 32 of Electrospray inlet probe 2. Countercurrent drying gas 33 passes through pressure regulator 54 junction 53, gas heater 34 and channel 35, exiting as heated counter current drying gas 37 into API source chamber 50 through opening 43 in nosepiece electrode 38. Nosepiece electrode 38 attached to endplate 39 comprise a single electrostatic lens that is heated by counter current drying gas 37 and multiple endplate heaters 45 configured in endplate assembly 46. Electrostatic lens 55 with attached grid 56 is positioned in API source Chamber 50 opposite nose piece electrode 38. Electrostatic lens 58, typically shaped as a cylindrical electrode, is configured along the electrically insulated walls of API source chamber 50. Dielectric capillary 40 with bore 44 is configured with its bore entrance 60 positioned in a region maintained at or near atmospheric pressure and with bore exit 61 positioned in first vacuum stage 64. Dielectric capillary 40 comprises entrance and exit electrostatic lenses 62 and 63 respectively.

DC electrical potentials are applied to Electrospray inlet probe tips 31 and 32, electrostatic lenses 28, 30, 38/39, 55/56, 58, and 62 during the generation of ions in API source chamber 50. The electric potentials applied to these electrostatic elements can be rapidly changed through user control or software program control to rapidly switch to different ion source operating modes. The first operating mode is essentially optimized single probe Electrospray ionization with MS acquisition. This first operating mode comprises Electrospray ionization of sample solution introduced through Electrospray inlet probe 1. In this operating mode, no solution is sprayed from Electrospray inlet probe 2. Typically, in this operating mode, ES inlet probe 1 with tip 31 is operated at ground potential. The voltages applied to capillary entrance electrode 62, nosepiece 38, grid 56, and cylindrical lens 58 may be operated at −5,000V, −4,000V, +100V and −3,500V respectively. The voltage applied to ring lens 28 is set to a value that optimizes ES performance falling between the nose piece 38 and ES inlet probe tip 31 potentials. In this operating mode, ES inlet probe 2 with exit tip 32 would be operated at ground potential and ring electrode 30 voltage would be set to optimize ES ion transmission into capillary orifice 44 through orifice entrance end 60. The configuration of ES inlet probe 2 can enhance the performance of ES inlet probe 1. Heated or unheated nebulizing gas may be turned on through ES probe 2 during ES inlet probe 1. Electrospray operation to aid in droplet drying and directing ions through nosepiece opening 43 and into capillary bore 44. Auxiliary heated drying gas 105 may be turned on during the Electrospraying of solution from ES inlet probe 1 to aid in drying the sprayed sample liquid droplets. Sample solution 8, flowing through ES inlet probe 1, is Electrosprayed from ES probe tip 31 with or without pneumatic nebulization assist. A portion of the ions produced from the evaporating charged droplets in Electrospray plume 41 move against counter current drying gas 37 driven by the electric fields and pass through nosepiece opening 43 and into capillary orifice bore through capillary orifice entrance 60. The applied electric fields move ions from chamber 50 through nose piece opening 43 and toward capillary entrance end 60. Ions are swept through capillary bore 44 by the gas flow expanding into vacuum and pass through a free jet expansion in vacuum chamber 64 as they exit capillary bore exit 61. With the appropriate electrical potentials applied to capillary exit lens 63, skimmer 68, ion guide 70 and mass analyzer 80, a portion of the ions passing through capillary bore 44 are directed through opening 67 of skimmer 68 and pass through ion guide 70 into mass analyzer 80 for mass to charge analysis and detection.

In the embodiment of the invention diagramed in FIG. 1, skimmer 68 serves as an electrostatic lens and a vacuum partition between vacuum stages 64 and 71. Ion guide 70 extends through vacuum stage 71 and into vacuum stage 73. Mass analyzer and ion detector 80 may be positioned in vacuum stage 73 or may be configured in one or more additional downstream vacuum stages. Vacuum stages 64, 71 and 73 are evacuated through vacuum ports 65, 72 and 74 respectively using vacuum pumps known in the art. Vacuum system 81 may comprise less than three or more than three vacuum stages as is practiced in the art depending on the ion optics and mass analyzer and detector used Mass analyzer 80 may include MS and $MS^n$ capability as is known in the art. Mass to charge analyzer and detector 80 may be configured as, but is not limited to, a Quadrupole, Triple Quadrupole, Fourier Transform Inductively Coupled Resonance (FTICR), Time-Of-Flight, Three Dimensional Ion Trap, Linear Ion Trap, Magnetic Sector, Orbitrap or hybrid mass spectrometer. Dielectric capillary 40 can be used to change the ion potential as ions traverse the capillary bore into vacuum as described in U.S. Pat. No. 4,542,293, incorporated herein by reference. This feature of capillary 40 operation allows Electrospray inlet probes 1 and 2 to be operated at or near ground potential for both positive and negative ion generation while introducing ions into vacuum at optimal voltages relative to mass analyzer 80. Dielectric capillary 40 effectively decouples the entrance 60 and exit 61 ends both physically and electrostatically allowing independent optimization of the ion source and vacuum ion optic regions. Alternatively, the invention may comprise different orifices into vacuum as is known in the art including, but not limited to, thin plate orifices, nozzles, or heated conductive capillaries configured with and without countercurrent drying gas near the orifice entrance. When non-dielectric capillaries are configured as the orifice into vacuum, the entrance and exit ends are operated at the same electrical potential, requiring that the Electrospray inlet probes be run at kilovolt potentials. Operating the Electrospray inlet probes at kilovolt potentials may require electrically insulating fluid connections to external inlet devices such as liquid chromatography separation systems. The invention may be configured with alternative vacuum ion optics components known in the art including but not limited to multipole ion guides configured in respective vacuum stages, ion funnels, sequential disk ion guides and/or electrostatic lenses.

Heated counter current drying gas 37 and auxiliary drying gas 105, provide enthalpy to promote drying of Electrosprayed droplets, and counter current drying gas 37 minimizes the entry of neutral contaminant species into capillary bore 44. All gas and vapor entering API source chamber 50 that does not pass through capillary bore 44, exits as gas mixture 83 through vent and drain 84. API source chamber 50 is typically configured with seals that prevent outside air from entering chamber 50, preventing undesired gas and contamination species that can affect the ionization processes and add contamination peaks in acquired mass spectra. API source chamber 50 may be operated at atmospheric pressure or above or below atmospheric pressure by applying respectively no restriction, some restriction or reduced pressure externally on vent or drain 84.

API source 4 may be run in a second operating mode configured to enhance Atmospheric Pressure Chemical Ionization of sample molecules evaporated in the nebulization-assisted Electrospray from ES sample inlet probe 1. In this second operating mode, solution is simultaneously Electrosprayed with pneumatic nebulization assist from ES inlet probe 2. The potentials applied to ES probe tips 31 and 32 and ring electrodes 28 and 30 are set to generate the same polarity Electrosprayed charged droplets from both ES inlet probes 1 and 2. The same polarity ions are generated from the resulting evaporating charged droplets sprayed from both ES inlet probes. The ion and neutral gas molecules produced in evaporating assisted Electrospray plume 41 mix with the ion and neutral gas molecules produced in evaporating assisted Electrospray plume 42 in mixing region 48. The composition of reagent solution 10, 11 or 12 is selected to maximize the ionization efficiency of neutral gas molecules evaporated in Electrospray plume 41 generated from ES inlet probe 1 while minimizing reactions with Electrospray ions generated from ES inlet probe 1 solution 8. For example, in positive ion mode, protonated ion species will be generated from solutions sprayed from both ES inlet probes 1 and 2. The reagent solution sprayed through ES inlet probe 2 is selected to generate ions with low proton affinity, which, when reacted with higher proton affinity neutral molecules evaporated from solution 8 in Electrospray plume 41, will transfer the proton from the reagent ion to the sample molecule, resulting in Atmospheric Pressure Chemical Ionization (APCI) of sample gas phase molecules. Reactions between Electrospray sample ions generated from ES probe 1 and Electrospray reagent ions generated from ES inlet probe 2 will be minimal due to charge repulsion between same-polarity ions. A portion of the ion population comprising APCI generated sample ions combined with Electrospray generated sample ions in mixing region 48 is directed into capillary entrance orifice 60 due to the electric fields, and is then directed to mass analyzer and detector 80 where the ions are mass to charge analyzed.

As is known, but not entirely characterized or understood, gas phase charge exchange reactions or Atmospheric Pressure Chemical Ionization processes can occur within the evaporating Electrospray plume produced from ES inlet probe 1. In the case of positive ion production, evaporated neutral molecules from sample solution 8 that have higher gas phase proton affinity compared with their solution proton affinity may charge exchange with Electrospray generated ions that have higher solution phase proton affinity but lower gas phase proton affinity relative to evaporated neutral molecule species. The addition of an independently generated population of low proton affinity gas phase ions can reduce the neutralization or charge suppression of sample Electrospray generated ions, improving sample ion signal intensity. The added proton donating species provide additional protons to ionize sample gas phase neutral molecules that could alternatively remove protons from Electrospray generated sample ions. In addition, the ion signal for less polar gas phase compounds can simultaneously increase due to an increased number of gas phase proton donor species available resulting in improved APCI efficiency of sample gas phase neutral molecules. Non proton cations such as sodium or potassium can be added to mixing region 48 through spray 42 from ES inlet probe 2 by spraying salt solutions whereby neutral sample molecules evaporated from solution 8 in spray 41 that have low proton affinity, but higher sodium or potassium affinity, can be ionized through APCI charge exchange processes. The nebulized and evaporated gas composition introduced through ES probe 2 can be modified by flowing additional gas 24 through valve 25. Auxiliary gas flow 24 can be manually or software program controlled by adjusting flow control valve 25 or changing the delivered gas pressure. Nebulizing gas 17 flowrate through ES inlet probe 2 can be controlled manually or through software programs by changing the output pressure of pressure regulator 26 or changing the setting of gas flow control valve 18. Nebulizing gas 17 and auxiliary gas 24 mix at junction 19 prior to passing through gas heater 20 and exiting at ES probe tip 32. The temperature of the nebulizing gas exiting from tip 32 of ES inlet probe 2 can be changed manually or through software control by adjusting the power to gas heater 20. Auxiliary gas 24 can be added to provide a specific gas phase reactant species in mixing region 48. Different ES inlet probe 2 spray solutions can be selected by switching valve 13 to select solutions 10, 11 or 12. Solutions 10, 11 and 12 may be delivered from any fluid delivery system known in the art including, but not limited to, syringe pumps, reciprocating piston pumps or pressure vessels. Solutions 10, 11 or 12 may contain different calibration solutions required in different analytical applications. The calibration solutions can be sprayed through ES inlet probe 2 and the resulting calibration ions mixed with the sample ions generated from ES inlet probe 1 in mixing region 48. A portion of the mixed ion population is swept through capillary bore 44 and mass to charge analyzed. This ion mixture produces a mass spectrum containing peaks that can be used for internal calibration, improving mass to charge measurement accuracy. Translator stages 21 and 22 can be used to adjust the relative and absolute positions and/or angles of ES inlet probes land 2 manually or through software control to maximize performance. For example, the location of the mixing region may be adjusted to maximize APCI efficiency and product ion sampling efficiency into capillary orifice 44 for a given liquid flow rate through ES inlet probe 1.

Figure 3:
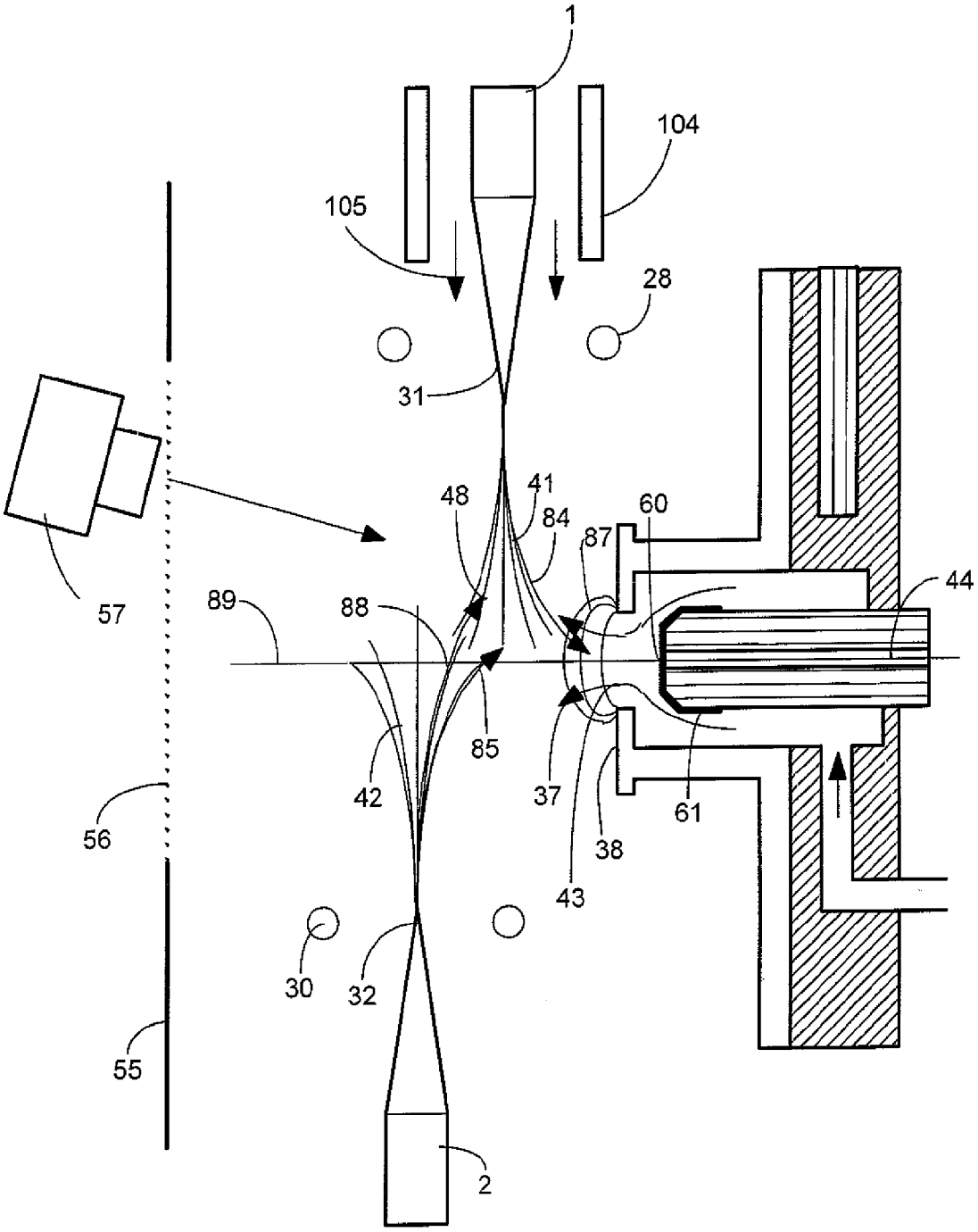
FIG. 3 is a diagram of an API source configured with two Electrospray liquid inlet probes positioned to provide mixing of a portion of each spray.

FIG. 3 is a diagram of the embodiment of the invention as shown in FIG. 1 with relative positions of ES inlet probes 1 and 2 adjusted to enhance combined ES and APCI sample ionization and sampling efficiency for a given sample solution flow rate. The same elements diagramed in FIGS. 1 and 3 retain the same numbers. As an example for positive ion mode operation, sample solution 8 is Electrosprayed through ES inlet probe 1 with pneumatic nebulization assist forming positive polarity Electrospray plume 41. Positive polarity Electrospray ions 84, formed from evaporating charged droplets, are directed against heated counter current drying gas 37 through opening 43 in nosepiece 38 by the electric field 87. Positive polarity reagent ions 88, generated from evaporating charged droplets in Electrospray plume 42 produced from ES inlet probe 2, are attracted toward opening 43 in nosepiece 38 by the same electric field 87. As shown in FIG. 3, ES inlet probe 2 has been positioned to spray toward API source centerline 89, but intersects centerline 89 further away from capillary orifice entrance 60 than the intersection of spray 41 with ion source centerline 89. Operating with the relative ES inlet probe positions shown, reagent ions 88 pass through and mix with spray plume 41 as ions 88 move toward nosepiece 38. The intersection of nebulizing gas flows generated from ES inlet probes 1 and 2 helps to improve the efficiency of reagent ion 88 mixing with neutral sample molecules in ES spray plume 41 in mixing region 48. APCI ionization of neutral sample molecules by low proton affinity reagent ions 88 occurs in mixing region 48. A portion of the resulting mixture of ES and APCI generated ions are directed into capillary bore 44 and mass to charge analyzed.

Figure 13:
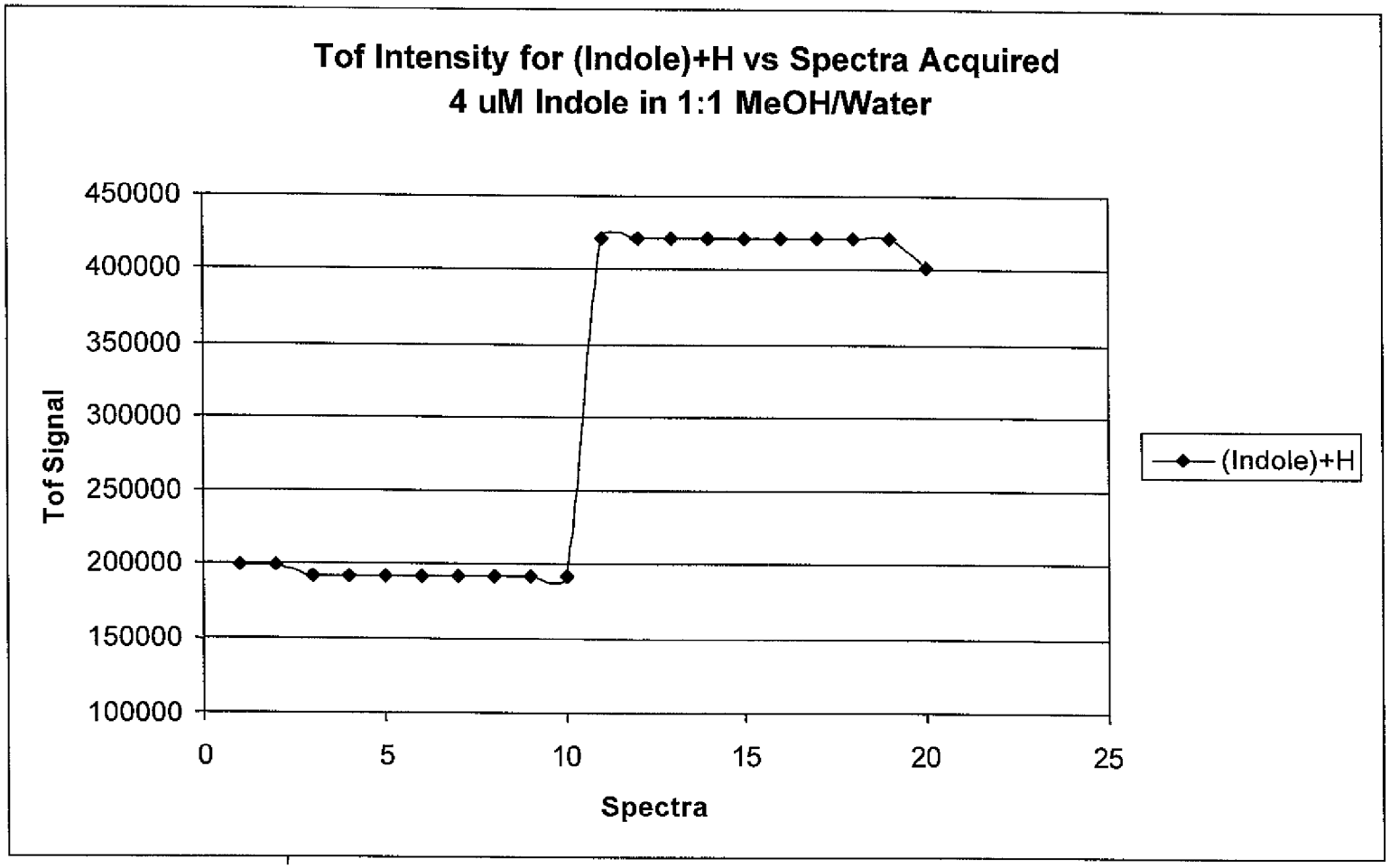

An example of increased sample ion signal due to improved APCI efficiency using intersecting dual Electrosprays is shown in FIG. 13. A 4 micromolar sample solution of indole in 1:1 methanol:water was Electrosprayed through ES sample inlet probe 1 with a second methanol solution Electrosprayed through ES inlet probe 2. ES inlet probes 1 and 2 were positioned as diagramed in FIG. 3. FIG. 13 shows the Time-Of-Flight MS ion intensity curve 90 of the Indole $(M+H)^+$ peak during MS acquisition. For the ion signal intensity shown in portion 91 of curve 90, no solution was Electrosprayed from ES inlet probe 2 while indole sample solution was Electrosprayed through ES sample inlet probe 1. Reagent solution Electrospray through ES inlet probe 2 was then switched on resulting in an increase in indole $(M+H)^+$ ion signal as shown in portion 92 of ion signal curve 90. Unheated nebulizing gas 17 through ES inlet probe 2 remained on throughout the entire data acquisition period. The indole protonated ion signal increased by over a factor of two due to increased APCI ionization efficiency in mixing region 48 of the intersecting Electrospray plume.

Figure 12:
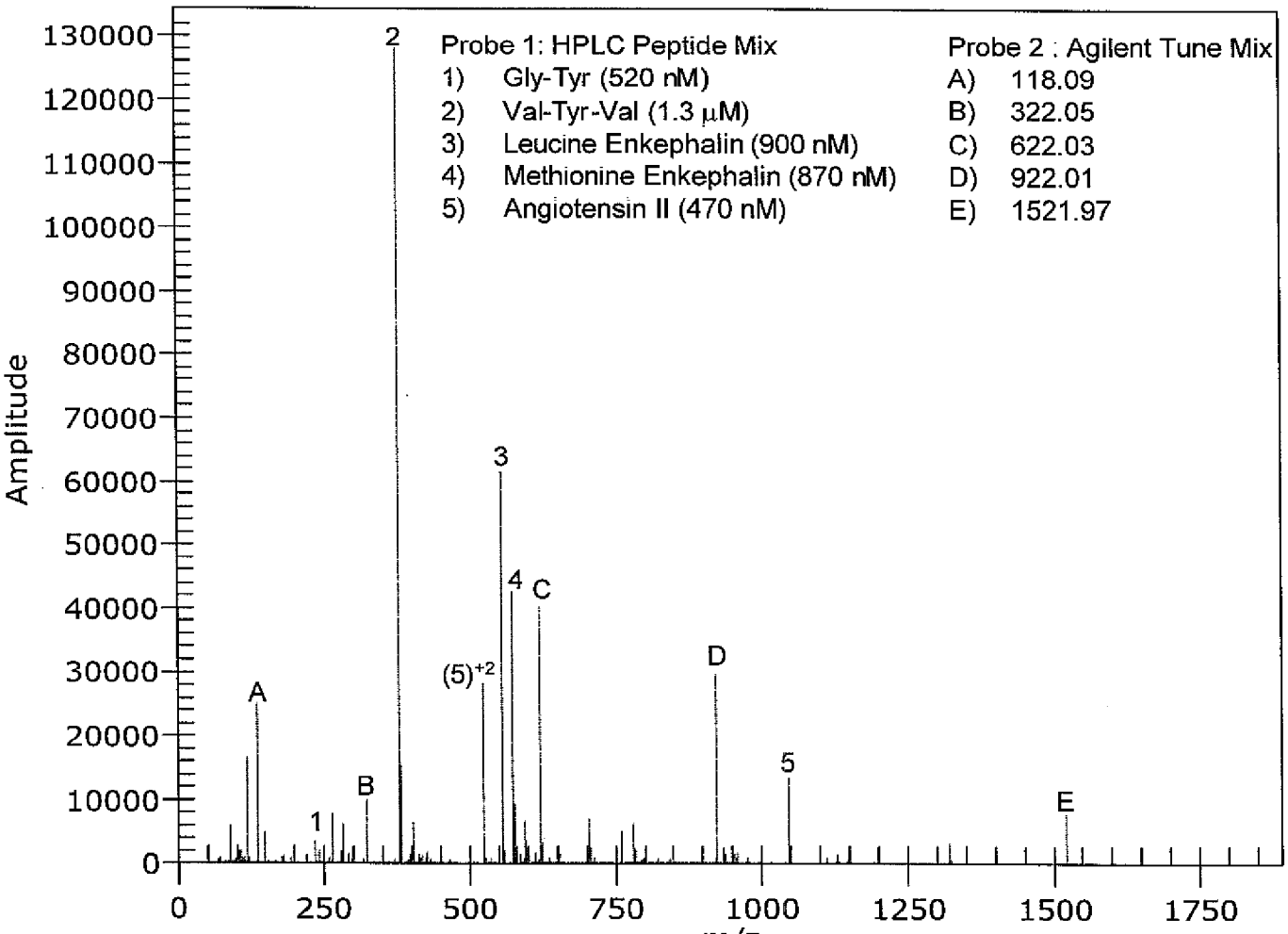
FIG. 12 is a mass spectrum showing the addition of calibration ions produced from a second ES inlet probe to the sample ions produced from a first ES inlet probe using the API source configuration as diagramed in FIG. 1.

With no change in hardware, ions used for internal calibration of acquired mass spectra can be added to the ion population generated from the sample solution Electrosprayed from ES inlet probe 1. Operating the API source as configured in FIG. 1, known calibration sample solution is Electrosprayed from ES inlet probe 2 by selecting the appropriate calibration inlet solution 10, 11, or 12 with valve 13. Known molecular weight calibration ions, generated by Electrospraying from ES inlet probe 2, mix with the sample solution ions generated from Electrospray inlet probe 1 in mixing region 48. A portion of the mixture of calibration and sample ions is sampled into vacuum through capillary bore 44 and mass to charge analyzed. FIG. 12 is a mass spectrum generated by mixing ions of sample peptides Electrosprayed from ES inlet probe 1 with calibration solution Electrosprayed from ES inlet probe 2. Simultaneously generated peptide and calibration ion populations were combined in mixing region 48, sampled through bore 44 of capillary 40 and mass to charge analyzed using an orthogonal pulsing Time-Of-Flight mass spectrometer. The acquired mass to charge spectrum shown in FIG. 12 comprise peaks of sample peptide ions labeled P1 through P5, and peaks of calibration ions labeled A through E. Calibration peaks A through E form an internal standard that can be used by data evaluation routines to improve mass to charge measurement accuracy of the remaining peaks in the MS spectrum.

Figure 14:
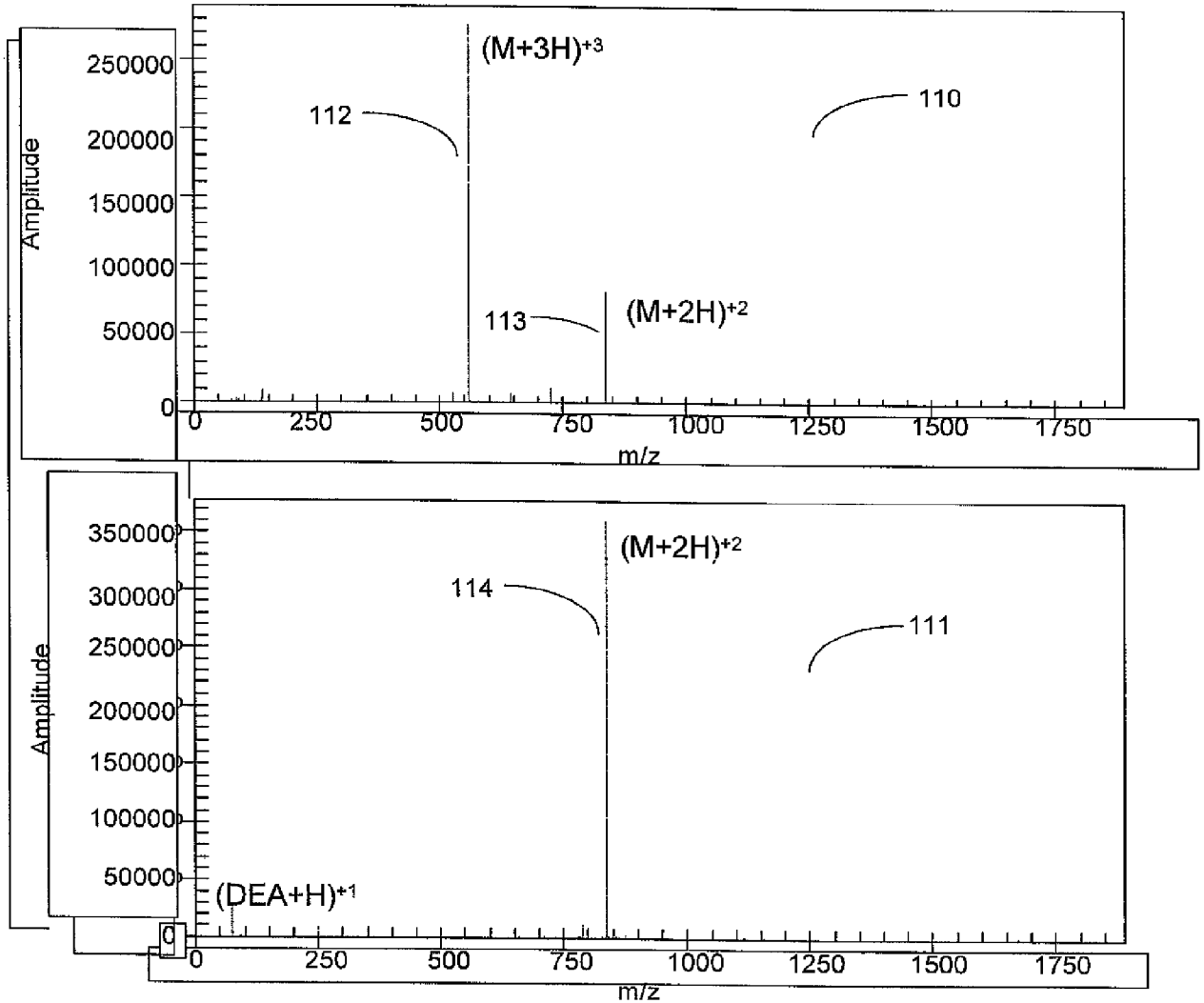
FIG. 14 includes two mass spectra showing charge reduction of Electrosprayed Neurotensin due to ion reactions with neutral diethylamine molecules introduced with the drying gas in an API source configured similar to that diagramed in FIG. 1.

The same API Source as configured in FIG. 1 can be operated in alternative modes with no change in hardware configuration. The multiple function API source as configured in FIG. 1 was operated in a mode to provide controlled charge reduction of multiply charged ions generated from sample solution Electrosprayed from inlet probe 1. Charge reduction of Electrospray generated multiply charged ions can be used to simplify a spectrum, shift overlapping peaks, increase mass spectrum peak capacity, and improve signal to noise of analyte compounds that have a series of multiply charged peaks in a mass spectrum. An example of controlled charge reduction operation is shown in FIG. 14. Referring to FIG. 14, mass to charge spectrum 110 was generated by Electrospraying, with pneumatic nebulization assist, a 6.3 micromolar sample of neurotensin in a 1:1 methanol:water with 0.1% glacial acetic acid solution at a liquid flow rate of 5 ul/min from ES inlet probe 1. Spectrum 110 was acquired with no charge reduction of the triply and doubly charged protonated neurotensin ions shown as peaks 112 and 113 respectively. To provide charge reduction of the triply charged neurotensin ion, reagent gas Diethyamine (DEA) was added through valve 52 into heated counter current drying gas 37 and mixed with Electrospray plume 41 in ES source chamber 50. The known proton affinity of DEA (952.4 kJ/mol) was selected to preferentially remove one proton from triply charged protonated neurotensin ions while minimizing charge reduction of the +2 protonated ion. Mass to charge spectrum 111 shown in FIG. 14 shows the doubly charged protonated molecular ion of neurotensin as the primary ion in the mass spectrum with a smaller peak of singly charged protonated DEA ions. This controlled charge reduction effectively eliminated the triply charged ions of neurotensin without generating a significant population of single charged ions. Charge reduction resulted in a simpler mass to charge spectrum with improved signal to noise of the primary analyte peak. In the example shown the amplitudes of the triple and doubly charged peaks, 112 and 113 shown in MS spectrum 110, are combined in the doubly charged peak 114 of neurotensin, shown in spectrum 111, with essentially no loss of ion signal. Rapid switching between charge reduction and non charge reduction operating modes as shown in FIG. 14 can be achieved through manual or software control by controlling the flow of reagent gas 51 through valve 52.

Optionally, charge reduction of multiply charged sample species Electrosprayed from ES inlet probe 1 can be achieved by introducing reagent gas 24 with the appropriate basicity through valve 25 and mixing reagent gas 24 with nebulizing gas 17. The nebulized gas, containing charge reducing reagent gas 24 introduced through ES probe 2, mixes with multiply charged ions generated from ES inlet probe 1 in mixing region 48. A portion of the resulting charged reduced ion population is sampled through capillary bore 44 of capillary 40 and mass to charge analyzed by mass to charge analyzer 80.

The multiple function multiple inlet probe API source as diagramed in FIG. 1 can be run in an alternative operating mode to enable charge reduction or Electron Transfer Dissociation (ETD) of multiply charged ions generated from ES inlet probe 1. Positive and negative polarity ions can be simultaneously generated from ES inlet probes 1 and 2, respectively, with such opposite polarity ions reacting in mixing region 48. As an example of such operating function, charge reduction or electron transfer dissociation of multiply charged positive ions can be performed for the first time at atmospheric pressure. Referring to FIG. 1, ES inlet probe 1 exit tip 31 is operated at ground potential with capillary entrance electrode 62, nosepiece and endplate 38/39 and ring electrode 28 operated at negative polarity potentials. With these voltages applied, Electrospraying from ES inlet probe 1 produces positive polarity multiply charged ions from a sample solution 8 containing higher molecular weight species. Negative polarity ions are produced from ES inlet probe 2 by lowering the potential applied to ES inlet probe tip 32 and ring electrode 30 to negative kilovolt potentials below that applied to nosepiece 37 and endplate 39. Alternatively, capillary entrance electrode 62 can be operated at near ground potential with ES inlet probe 1 tip 31 and ES inlet probe 2 tip 30 operated at positive and negative kilovolt potentials respectively. Negative polarity ions generated from ES inlet probe 2 react with multiply charged positive ions generated from ES inlet probe 1, resulting in charge reduction and/or electron transfer dissociation of multiply charged positive polarity ions. The degree of charge reduction and/or ETD achieved will depend on the negative ion species generated, the concentration of negative ions, and the efficiency of reactions occurring in mixing region 48. To effect electron transfer dissociation of positive polarity multiply charged ions, a negative ion species with very low electron affinity is required as described by Coon et al., referenced above in their work on ETD in linear ion traps. The considerable damping of translational energy of ions due to collisions with neutral background molecules at atmospheric pressure limits the collisional energy between positive and negative ions during reactions at atmospheric pressure. Consequently, even in the presence of kilovolt electrical potentials, reactions between positive and negative ions remain low energy events favorable to ETD processes. Charge reduction or ETD operation can be rapidly switched on and off by rapidly changing the voltage applied to ring electrode 30 or by turning on and off the solution flow through ES inlet probe 2.

Figure 4:
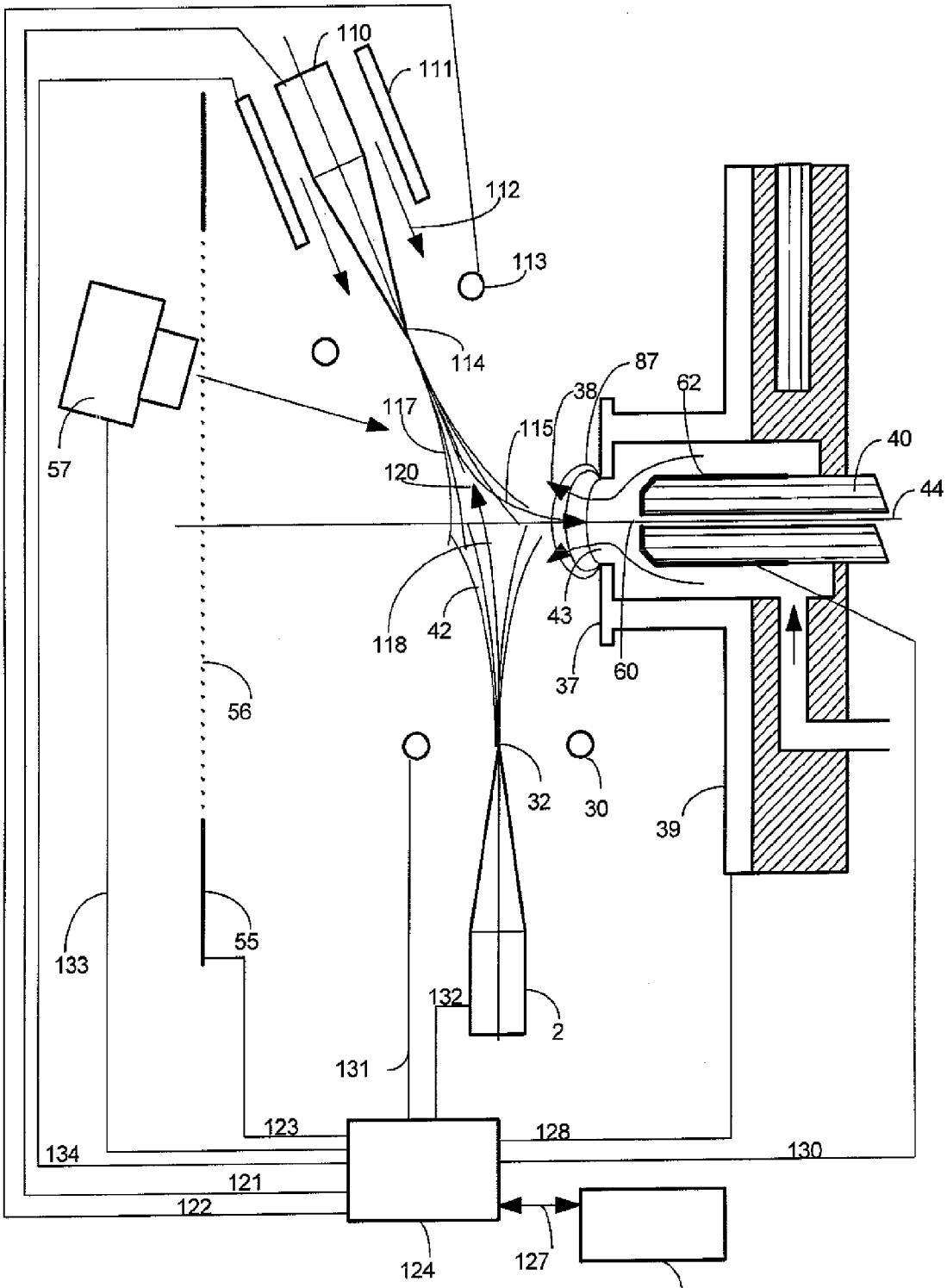
FIG. 4 is a diagram of an API source configure with two Electrospray liquid inlet probes oriented at different angles and positioned to provide intersecting sprays.

The relative positions of ES inlet probes 1 and 2 can be adjusted to maximize reaction efficiency between simultaneously produced positive and negative ions. Referring to FIG. 4, an alternative embodiment of the API source shown in FIG. 1 is diagramed where the position of ES inlet probe 1 has been repositioned so that the centerline of ES inlet probe 1 has been rotated toward nosepiece entrance 43. Similar elements to those shown in FIG. 1 retain the same numbers. Negative ions 118 are produced in spray plume 42 from pneumatic nebulization assisted Electrospray generated from exit tip 32 of ES inlet probe 2. Multiply charged positive ions 115, generated from sample solution Electrosprayed with pneumatic nebulization assist from ES inlet probe 110, are directed toward capillary bore entrance 60 against heated counter current drying gas 38. Electric fields 87 direct positive polarity ions 115 toward capillary bore entrance 60 and direct negative polarity ions 118 to move away from nose piece electrode 37. Negative polarity ions 118 moving away from the negative kilovolt potential nose piece electrode 37 are attracted to the grounded ES inlet probe tip 114 providing an efficient mixing and reaction region 120. Voltages are applied to electrodes 55/56, 113, 30, 37/39, 62, 111 and ES inlet probes 110 and 2 from multiple voltage power supply 124 through connections 123, 122, 131, 128, 130, 134, 121 and 132 respectively. Voltage may also be applied to infrared lamp 57 from power supply 124 through connection 133 to increase the rate of droplet drying in ES spray plume 117 generated from ES inlet probe 110. The voltages applied through power supply 124 are controlled manually or through software using controller 125 via communications link 127. Voltages may be rapidly switched manually or through software control through controller 125 when rapid switching between ion source operating modes is desired. Positive or negative ions may be generated from ES inlet probe 1 while positive or negative ions may be independently produced from ES inlet probe 2.

Figure 2:
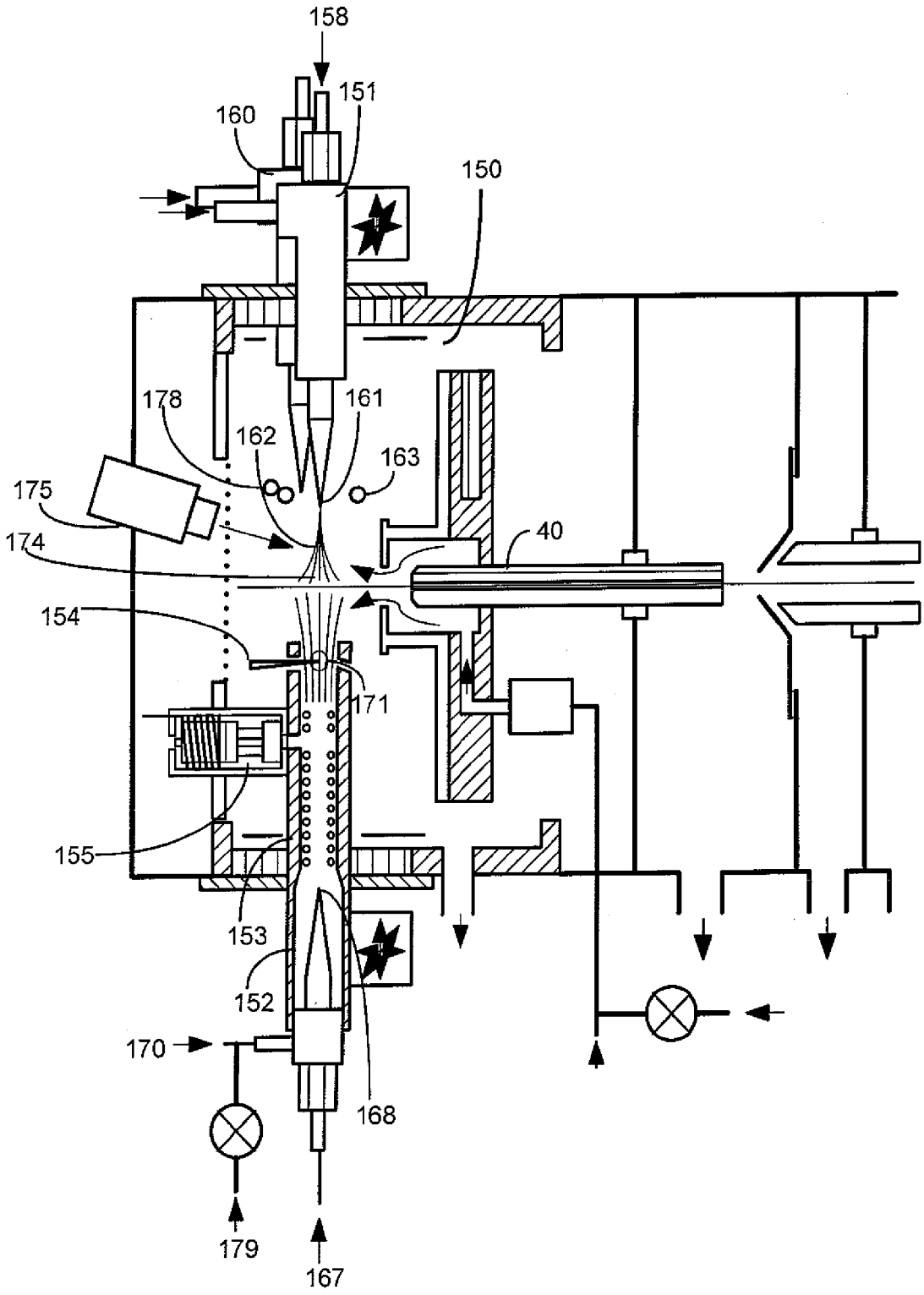
FIG. 2 is a diagram of an atmospheric pressure ion source comprising two parallel Electrospray liquid inlet probes and a combined Corona Discharge APCI and Photoionization liquid inlet probe oriented to provide a mixing region for the probe outlets.

An alternative embodiment of the invention is diagramed in FIG. 2 where multiple function API source 150 is configured with ES inlet probes 151 and 160 and pneumatic nebulization inlet probe 152 configured with vaporizer heater 153, corona discharge needle 154 and/or photoionization lamp 155. Sample solution 158. Electrosprayed with pneumatic nebulization assist from ES inlet probe tip 161 forms Electrospray generated ions in spray plume 162. A second ion population is generated from inlet probe 152 by corona discharge ionization, photoionization or a combination of both. Solution 167 is pneumatically nebulized from tip 168 with nebulizing gas 170 and evaporated in vaporizer heater 153. A portion of the vaporized gas is ionized in corona discharge region 171 and/or through photoionization from the UV photons emitted from discharge lamp 155. Dopant gas 179 may also be added to nebulizer gas 170 to enhance the efficiency of APCI charge transfer from photoionzed dopant reagent ions to gas phase sample molecules. The neutral and ion population produced from inlet probe 152 mixes with the neutral and ion population generated from ES probes 151 and/or 160 in mixing region 174. Ions generated from inlet probe 152 ionize neutral sample molecules in spray plume 162 through APCI reactions. Selected reagent ion populations can be produced in inlet probe 152 from the corona discharge or photoionization processes that maximize the APCI efficiency of neutral molecules in ES spray plume 162. The ion populations produced from inlet probe 152 can be different from the reagent ion population produced from ES inlet probe 151, allowing increased flexibility to maximize neutral molecule ionization efficiency. Infrared lamp 175 aimed at ES spray plume 162 increases the drying rate of sprayed droplets particularly for higher ES liquid flow rate applications. Additional Electrospray inlet probe 160 can be operated to introduce additional ion populations, such as calibration ions, into mixing region 174. Ion production from ES inlet probes 151 and 160 may be turned off while continuing to spray solution by adjusting the voltages applied to ring electrodes 163 and 178 respectively. APCI-only ion generation from sample solution 158 can be achieved by nebulizing a net neutral droplet spray of sample solution 158 from ES probe 151 tip 161 and reacting the neutral molecules evaporated from spray plume 162 with corona discharge or photoionization produced reagent ions generated from inlet probe 152 in mixing region 174.

Figure 10:
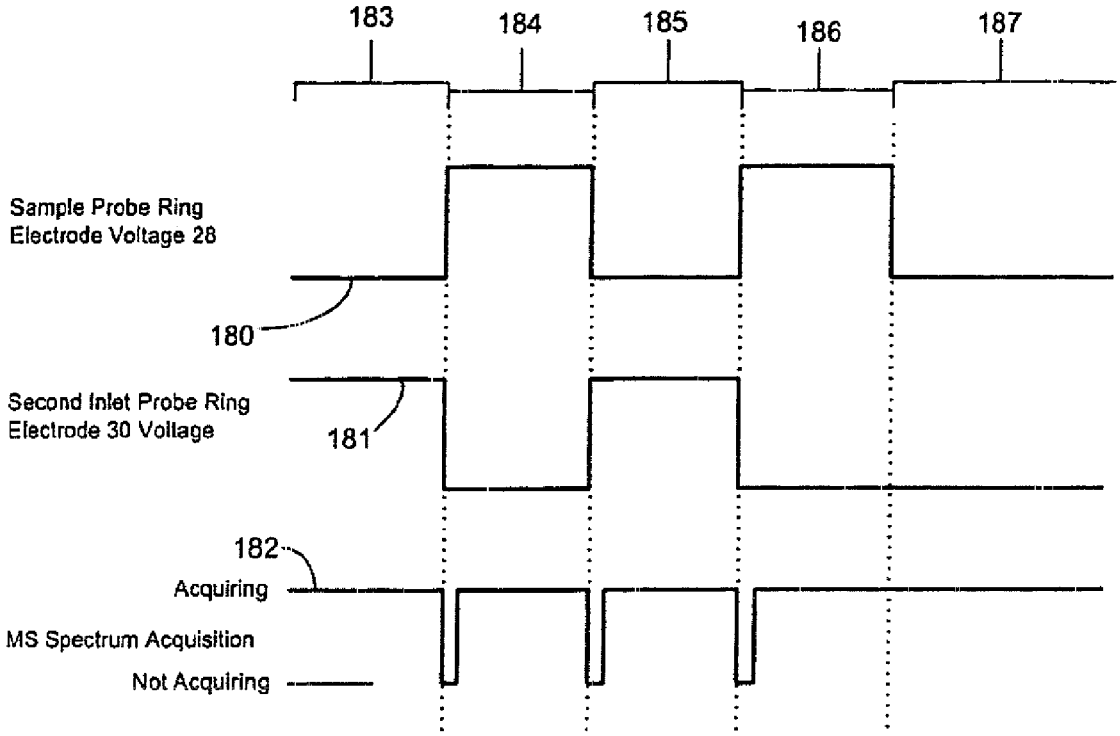
FIG. 10 is a timing diagram showing switching between ES and APCI operating modes.

The multiple function ion source embodiments diagramed in FIGS. 1 and 2 can be controlled to rapidly switch between different ion production modes during MS data acquisition. FIG. 10 is a timing diagram of a voltage switching pattern that can be employed to switch between ES only, APCI only and mixed ion production modes. Switching between ionization modes, respectively, in API sources 50 and 150 in FIGS. 1 and 2 is accomplished by switching voltages applied to ring electrodes 28 and 30 in the embodiment shown in FIG. 1 and ring electrodes 163 and 178 and corona discharge needle 154 in the embodiment shown in FIG. 2 while holding all other electrode voltage constant. Referring to the timing diagram in FIG. 10, corresponding to the apparatus illustrated in FIG. 1, line 180 shows the voltage applied to ring electrode 28 and line 181 refers to the voltage applied to ring electrode 30. Line 182 shows when MS spectra are being acquired. During time periods 183 and 185, positive polarity Electrospray-only ionization occurs. During time period 183 the voltage is reduced on ring electrode 28 relative to ES inlet probe tip 31 to allow production of charged droplet sprays from ES inlet probe 1. The voltages applied to ring electrode 30 is set close to the voltage applied to ES inlet probe tip 32 to prevent net charging of the solution spraying from ES inlet probe 2 and subsequent APCI of neutral molecules in mixing region 48. During time periods 184 and 186 positive polarity APCI is the primary ionization mode of nebulized sample solution 8. During time periods 184 and 186, the voltage applied to ring electrode 28 is increased to close the voltage applied to ES inlet probe tip 31, as shown by line 180, resulting in net neutral charged droplet production from ES inlet probe 1. Conversely, the voltage applied to ring electrode 30 is reduced to turn on charged droplet spraying of solution from ES inlet probe 2. Reagent ions produced from ES inlet probe 2 react with neutral molecules in mixing region 48 to forming ions from sample molecules through APCI processes. During time period 187, the voltages applied to both ring electrodes 28 and 30 are switched low to simultaneously generate positive polarity sample ions from both ES inlet probe 1 and reagent ions from ES inlet probe 2. Reagent ions formed from ES inlet probe 2 react with neutral sample molecules evaporated from ES spray plume 41 in mixing region 48. This enables the simultaneous generation of ions from sample solution through ES and APCI processes. In a similar manner, ES and APCI only and combination modes can be switched on and off in API source 150 diagramed in FIG. 2 by applying the appropriate voltages to ring electrode 163 and 178 and corona discharge needle 154 while holding other ion source electrode voltages constant. In the example shown in FIG. 10, ion source operating mode switching occurs between spectrum acquisitions. Alternatively, ion source operating mode switching can occur rapidly during MS spectrum acquisition.

Figure 11:
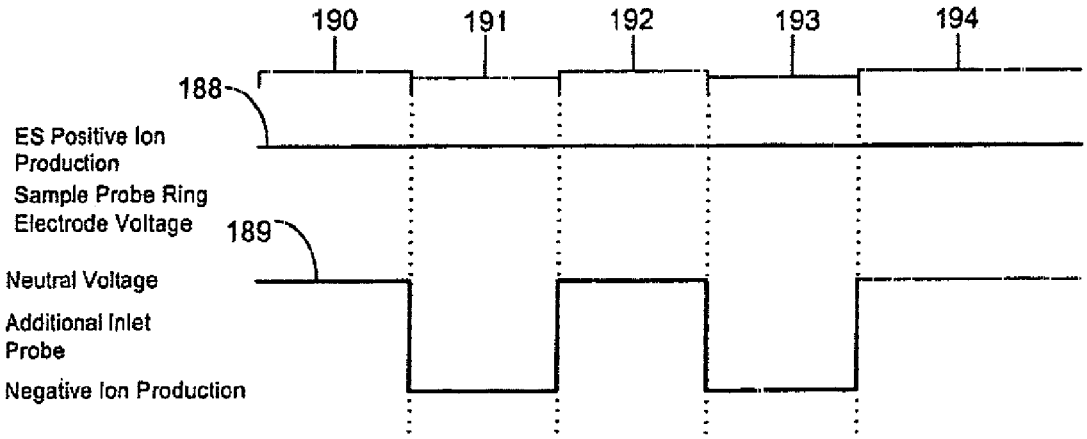
FIG. 11 is a timing diagram showing switching between single and opposite polarity ion production.

FIG. 11 shows the timing diagram for switching between Electrospray ionization and Electrospray ionization with Electron Transfer Dissociation modes in the dual ES inlet probe API source diagramed in FIG. 1 and FIG. 4. All electrode voltages are held constant in the dual ES probe API source and only the potential applied to ES inlet probe 2 is switched between modes. During Time periods 190, 192 and 194, positive polarity multiply charged ion generation occurs with no ETD fragmentation. The voltage applied to ES inlet probe 2 is set close to the voltage applied to ring electrode 30 to prevent production of negative polarity ions. Alternatively, the solution flow through ES inlet probe 2 can be turned off during these time periods. During time periods 191 and 193 ES ionization and ETD ion fragmentation processes occur. The solution flow through ES inlet probe 2 is turned on and the voltage applied to ES probe exit 32 is switched low so that negative Electrospray ions are produced from ES probe 2. The negative polarity ions react with positive polarity ions in mixing region 48 of FIG. 1 or 120 of FIG. 4 whereby electrons are transferred from the negative polarity ions to positive polarity multiply charged ES generated ions resulting in Electron Transfer Dissociation of the multiply charged positive polarity ions.

Figure 5:
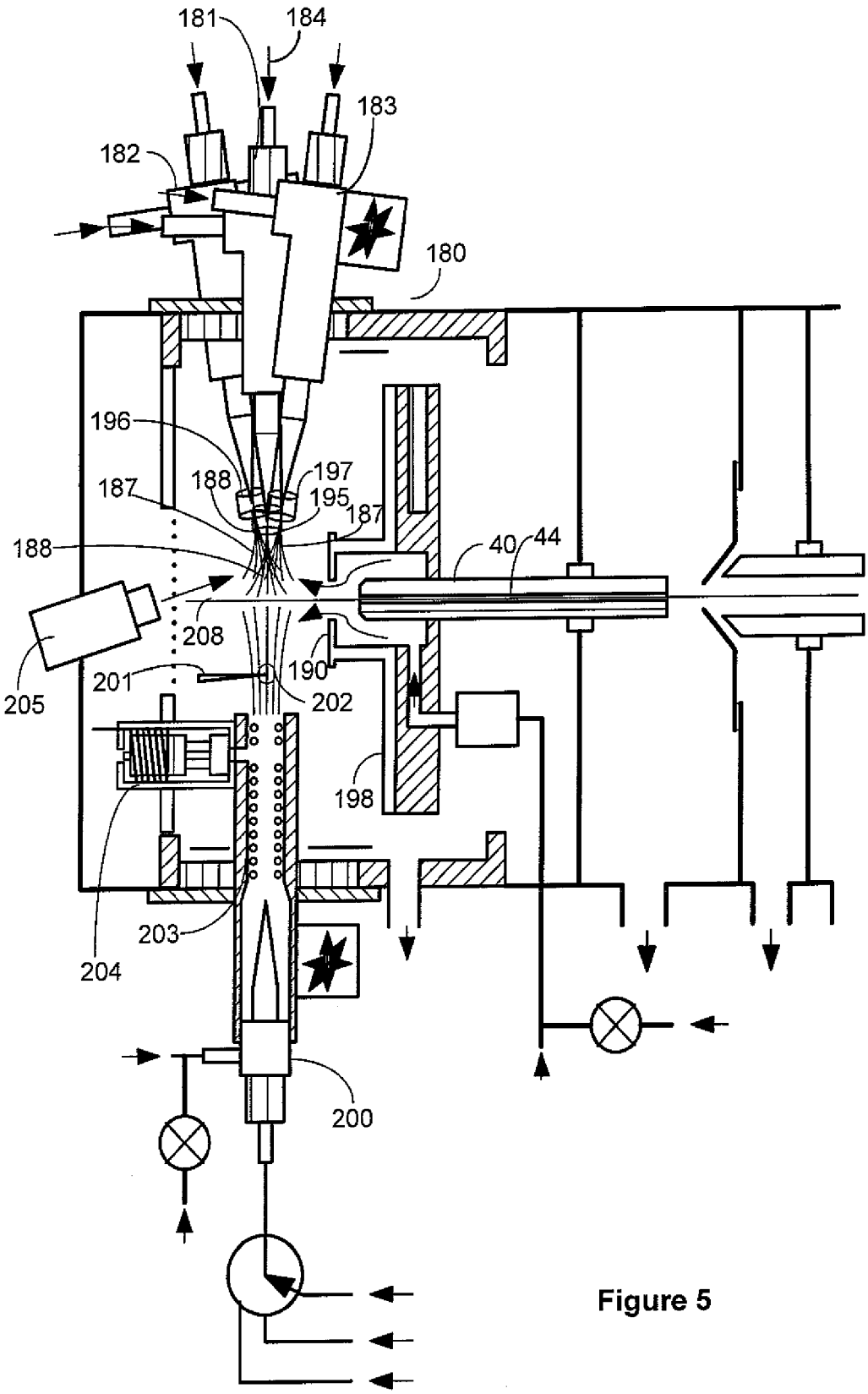
FIG. 5 is a diagram of a multiple inlet probe ion source with three Electrospray liquid inlet probes and a combination corona discharge APCI and Photoionization liquid inlet probe all positioned to provide a mixing region for the probe outlets.
Figure 6:
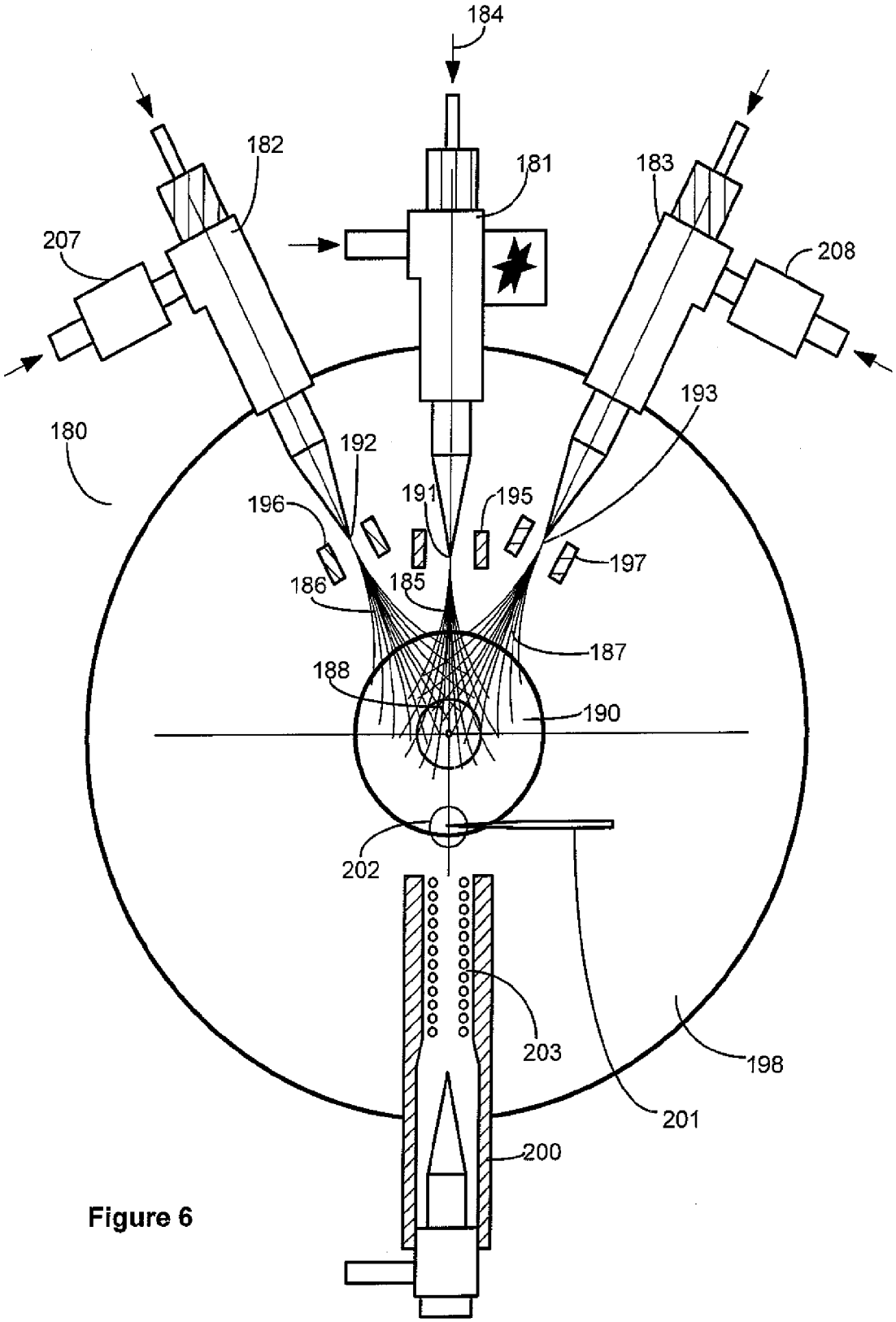
FIG. 6 is an alternative along the vacuum orifice axis of the multiple inlet probe API source shown in FIG. 5.

An alternative embodiment of the invention is diagramed in FIGS. 5 and 6 wherein an Electrosprayed or nebulized and evaporated primary sample solution can mix with independently generated gas phase neutral molecule and ion populations produced from Electrospray, corona discharge and/or Photoionization processes FIG. 5 is a side view and cross section of API source 180 and FIG. 6 is an end view looking into the bore of capillary 40 bore 44 in API source 180. Gas phase ions and neutral species generated from inlet probes 182, 183 and 200 are mixed in common mixing region 188 with a primary sample solution spray 185 generated from ES inlet probe 181. Referring to FIGS. 5 and 6, sample solution 184 is introduced into multiple function ion source 180 through ES inlet probe 181 ES inlet probes 182 and 183 positioned on either side of ES inlet probe 181 are angled to spray into common mixing region 188. ES inlet probes 181, 182 and 183 comprise exit tips 191, 192 and 193, respectively, incorporating pneumatic nebulization. Exit tips 191, 192 and 193 are surrounded by ring electrodes 195, 196 and 197, respectively, to allow independent control of applying a high or low electric field at each ES inlet probe exit tip ES inlet probes 182 and 183 comprise nebulization gas heaters 207 and 208, respectively, to aid in the rapid drying of liquid droplets generated from ES inlet probes 181, 182 and 183. In the embodiment shown in FIGS. 5 and 6, ES inlet probes 182 and 183 can be operated to spray simultaneously with similar liquid and heated nebulized gas flow rates. Evaporating spray plumes 186 and 187 generated from ES inlet probes 182 and 183 respectively enter mixing region 188 with opposing symmetry providing efficient mixing with sample solution spray plume 185 over a wide range of liquid flow rates. Minimum adjustment of spray variables is required to achieve optimal multiple function ion source performance. Analogous to the API source embodiment shown in FIG. 1, reagent ions generated from ES inlet probes 182 and 183 react with neutral gas phase molecules produced in sample solution spray plume 185 to generate sample solution ions through APCI processes. Alternatively or simultaneously, calibration solution can be sprayed from either or both ES inlet probes 182 and 183 to add calibration peaks to acquired MS spectra. Net charged droplet production from ES inlet probes 181, 182 and 183 can be individually and independently turned on or off by switching voltages on ring lenses 195, 196 and 197 respectively. By setting the ring electrode voltage close to the voltage value applied to the respective ES inlet probe exit tip, net neutral droplets will be pneumatically nebulized from the respective inlet probe exit tip. Positive charged droplets can be Electrosprayed with pneumatic nebulization assist when the ring lens voltage is set lower than the respective ES inlet probe exit tip voltage. For negative polarity Electrospray charged droplet production, the ring lens voltage is set higher than the respective ES inlet probe exit tip voltage. Specific relative voltages set between the ES inlet probe exit tip and the ring lens for optimal charged droplet spraying will vary with specific lens and exit tip positions. Relative lens to ES probe tip voltage is generally set to maximize spray current for a given solution while avoiding the occurrence of corona discharge at the exit tip.

The switching of voltages applied to ring lenses allows ES only, APCI only or combination ES and APCI ionization of sample molecules sprayed from ES inlet probe 181. Alternatively, liquid solution flow through ES Inlet probes 182 and 183 can be turned on and off to promote or minimize APCI of gas phase sample molecules present in spray plume 185. Infrared lamp 205 can be turned on to increase the rate of liquid droplet evaporation in spray plumes 185, 186, and 187 particularly for higher liquid flow rates. The liquid flow rates through ES inlet probes 182 or 183 can be reduced relative to primary sample solution flow rate through ES inlet Probe 181 to minimize the total solution evaporation required. The total current or reagent ion production from ES inlet probes 182 and 183 can be maximized even with low liquid flow rates by adjusting solution chemistry and applied voltages. Alternatively, reagent ion production can be maximized using ES inlet probes configured with a cation or anion membrane transfer region as described in U.S. Patent Application No. 60/573,666 and incorporated herein by reference. ES inlet Probes 182 and 183 can be operated to produce ions of opposite polarity from the ion polarity generated from ES inlet probe 181. Ring electrodes 196 and 197 electrically shield the local field at exit tips 192 and 193 respectively from modifying the electric field applied locally at exit tip 191 of sample solution inlet probe 181 during opposite polarity ion production. As described for the embodiment shown in FIG. 1 above, negative ions generated from ES inlet probes 182 and 183 can react in mixing region 188 with positive polarity multiply charged ions generated from the sample solution Electrosprayed from ES inlet probe 181 to cause charge reduction or ETD of sample multiply charged ions. Rapid switching between ES, APCI, charge reduction, ETD, addition of calibration ions and combinations of these ion source operating modes can be achieved through manual or software control.

The API source embodiment diagramed in FIGS. 5 and 6 comprises solution inlet probe 200 with vaporizer heater 203, corona discharge needle 201 and photoionization lamp 204. Ions generated from solution inlet probe 200 can be selectively added to mixing region 188 analogous to the API source functions described for API source embodiment 150 diagramed in FIG. 2. Liquid flow rate through solution inlet probe 200 can be minimize and the desired reagent ion current maximized by selecting optimal solution chemistries and applying the appropriate potential to corona discharge needle 201. Liquid flow rates and voltages applied to solution inlet probe 200 with corona discharge needle 201 and photoionization lamp 204 can be controlled independently from the variables applied to ES inlet probes 181, 182 and 183 to maximize performance in API source multiple mode operation.

Figure 7:
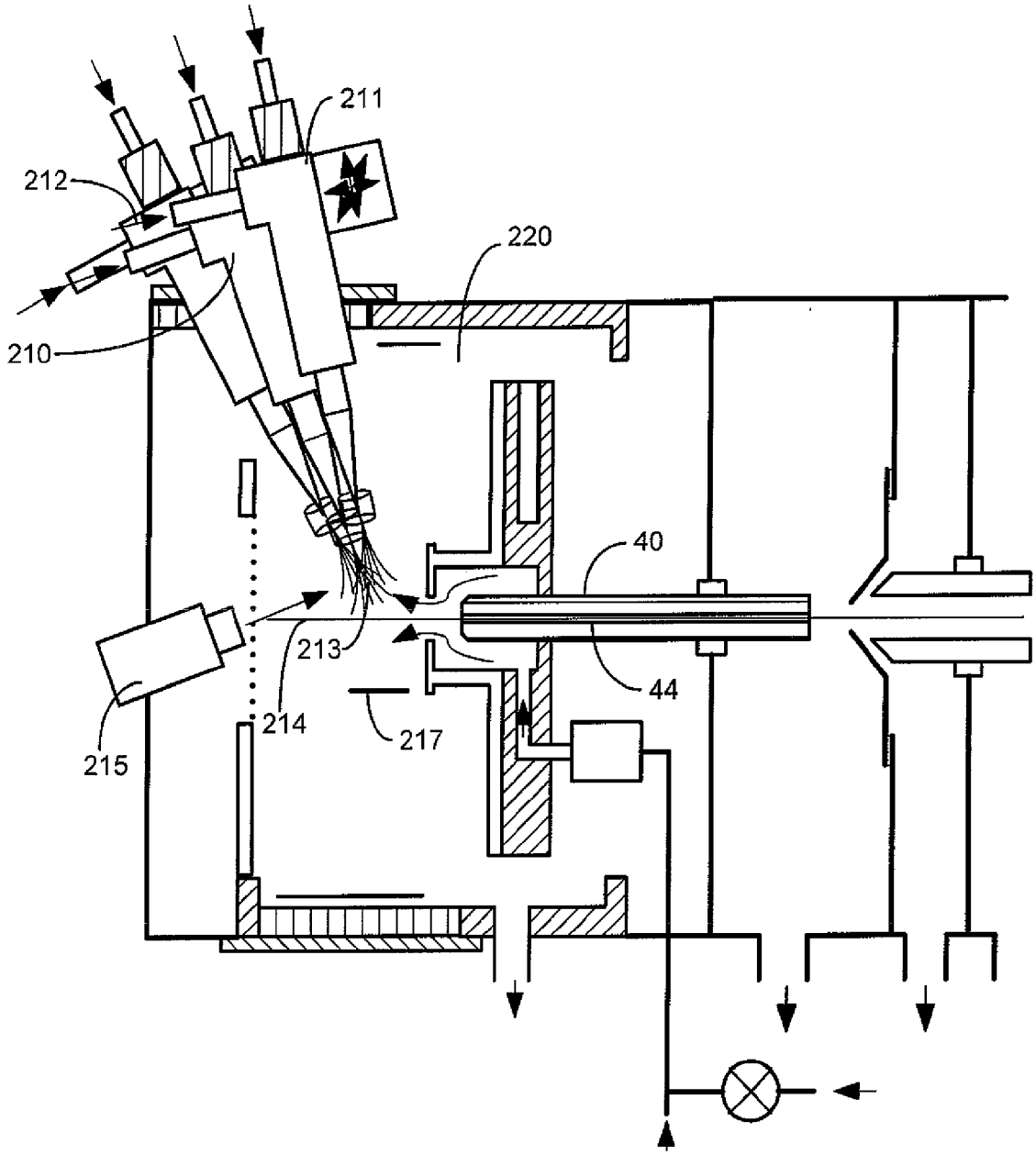
FIG. 7 is a diagram of the API source comprising three Electrospray inlet probes positioned to spray at an angle to the API source centerline.

The centerline and spray direction of ES inlet probes 181, 182 and 183 may be positioned at different angles relative to ES source centerline 208 as diagramed in FIG. 7. FIG. 7 shows three ES inlet probes 210, 211 and 212 oriented to spray toward common mixing region 213 but angled relative to centerline 214 of API source 220. Adjustable angling and X-Y-Z translation of ES inlet spray probes 210, 211 and 213 relative to API source centerline 214 allows for optimization of ion transmission into capillary 40 bore 44. Sprayed droplet drying efficiency can be enhanced by turning on infrared lamp 215 directed at the spray plumes produced from ES inlet probes 210, 211 and 212. Additional electrostatic lenses such as electrode 217 can be positioned in API source 220 to aid in directing sample ions into vacuum through capillary bore 44 for mass to charge analysis.

Figure 8:
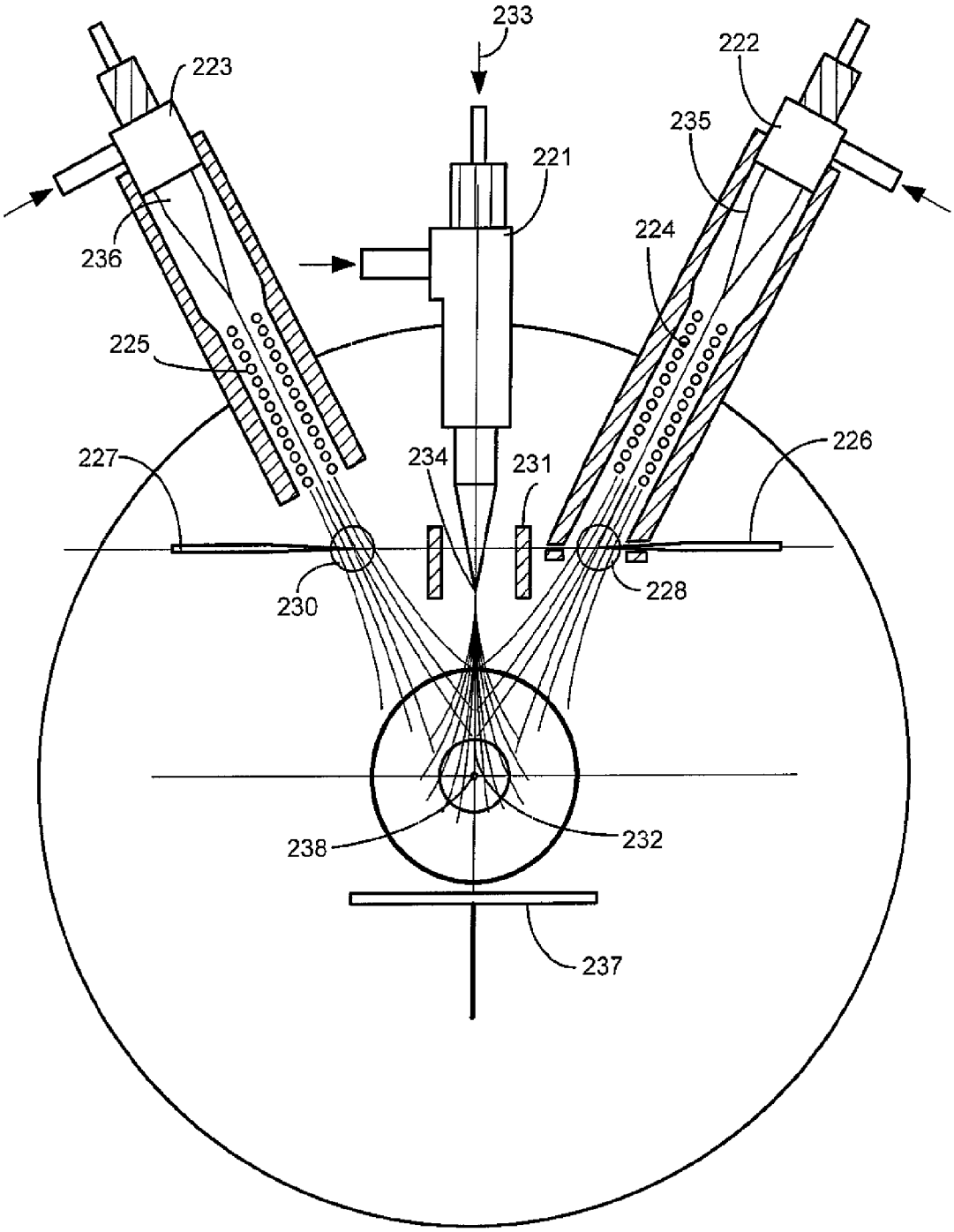
FIG. 8 is a diagram of the multiple function API source comprising one Electrospray and two corona discharge APCI liquid inlet probes all positioned to provide a mixing region.

An alternative embodiment to the multiple function API source invention is shown in FIG. 8. ES inlet probes 182 and 183 diagramed in FIGS. 5 and 6 have been replaced by solution inlet probes 222 and 223 comprising pneumatic nebulizers 235 and 236, vaporizer heaters 224 and 225 and corona discharge needles 226 and 227 respectively. Ring electrode 231 surrounding ES inlet probe 221 exit tip 234 shields the electric field formed at exit tip 234 from electric fields formed at the tips of corona discharge needles 226 and 227. Ions generated in corona discharge regions 228 and 230 enter mixing region 232 and charge exchange with evaporated sample neutral molecules produced independently from ES inlet probe 221. Sample solution 233 can be Electrosprayed or sprayed as a net neutral droplet plume by switching the voltage applied to ring electrode 231. Ions can be selectively formed from sample molecules through Electrospray or gas phase APCI processes or a combination of both in mixing region 232 ES, APCI or combination ionization processes can be rapidly turned on and off by switching voltages applied to ring electrode 231, and corona discharge needles 226 and 227. In one preferred operating mode, the liquid flow rates and nebulizing gas flow rates run through solution inlet probes 222 and 223 are set approximately equal to provide symmetric mixing in mixing region 232. This symmetry of independent reagent ion and heated neutral gas flow into mixing region 232 minimizes the adjustment of variables to achieve optimum ionization and MS detection performance even for different sample solution flow rates. For each source operating mode, the voltage applied to electrode or grid 237 is set to maximize ion transmission into vacuum through capillary orifice 238 for mass to charge analysis. Alternatively, electrode or grid 237 may be configured with a different shape and position to maximize ion transmission into capillary orifice 238 for different positions of inlet probes 221, 222 and 223. Rapid switching between API source operating modes can be achieved using manual or software control.

Figure 9:
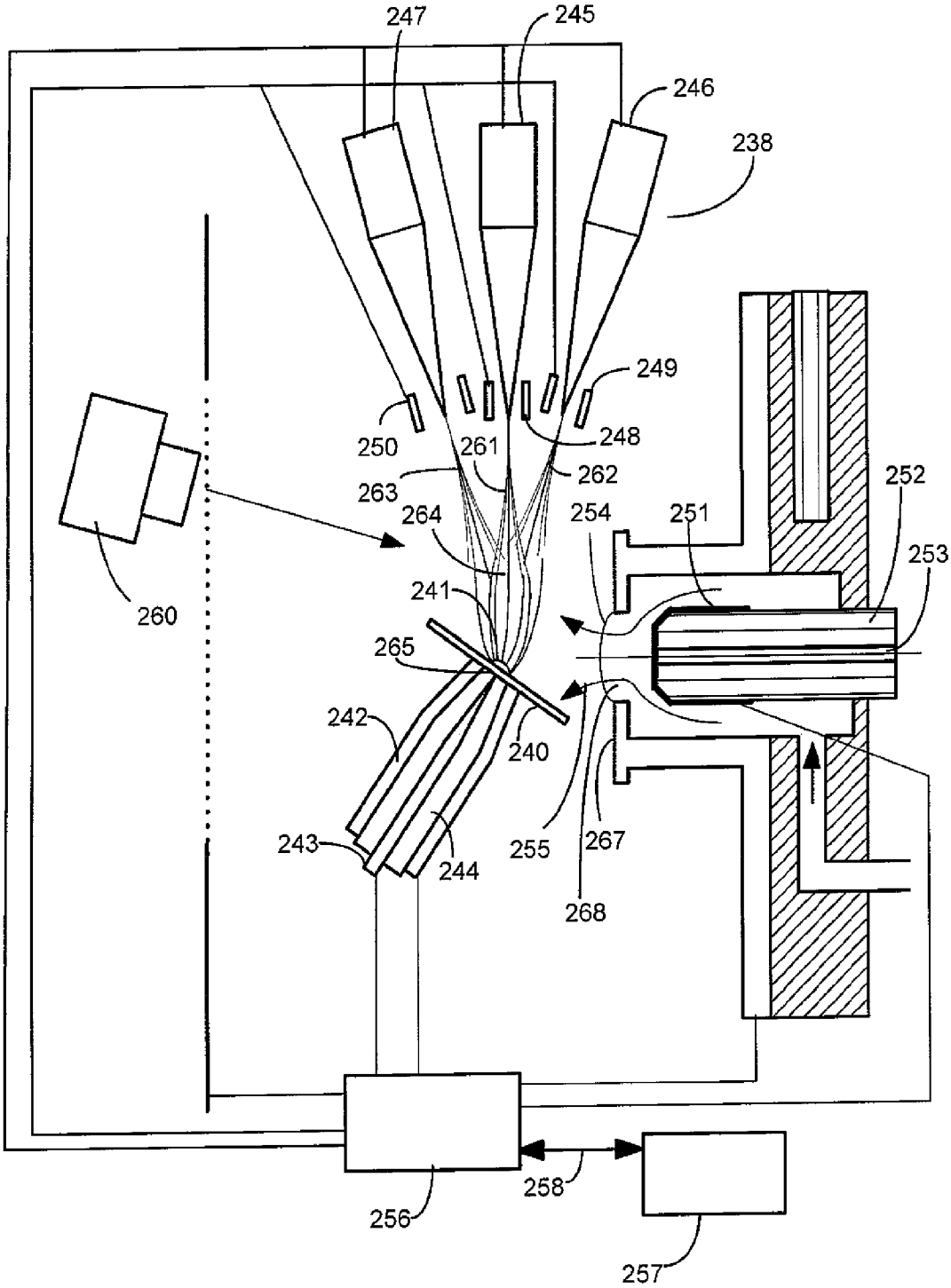
FIG. 9 is a diagram of an API source including one Electrospray probe and a sample target probe configured so that the ES spray impinges on the target probe surface.

Electrodes 217 and 237 diagramed in FIGS. 7 and 8 can be replaced by a sample bearing surface as shown in FIG. 9. Ions form from molecules of sample 241 located on sample surface 240 by the impingement of ions or charged droplets onto sample 241 followed by a rapid reversal of electric field. The rapidly reversing electric field aids in separation of sample ions from the surface and into the gas phase. Resulting gas phase sample ions are directed into a mass spectrometer in vacuum through capillary 252 bore 253 where they are mass to charge analyzed. The ionization process as described in U.S. patent application Ser. No. 10/862,304 incorporated herein by reference may also include a laser pulse to separate the sample ions from the charged surface. The ionization process described in U.S. patent application Ser. No. 10/862,304 can be included in a preferred embodiment of the multiple function API source. Referring to FIG. 9, ES inlet probes 245, 246 and 247 with ring lenses 248, 249 and 250, respectively, are configured in multiple function API source 238. Using operating modes as described above, specific populations of gas phase ions or even partially evaporated charged droplets can be directed to impinge on sample 241 located on sample bearing surface 240. Sample surface 241 and the gas phase region above sample 241 serve as the mixing region described in alternative embodiments above. In the embodiment shown, sample bearing surface 240 comprises a dielectric material positioned in proximity to electrodes 243 and 242 separated by electrical insulator 244. During the impingement of ions or charged droplets on the surface of sample 241, shown as time period 280 in FIG. 15, voltages are applied to center electrode 243 and shielding electrode 242, respectively, as depicted during time period 180 in FIG. 15, to create a local high potential attractive field at sample 241 above electrode 243 tip 265. Charged droplets and ions generated in spray plumes 261, 262 and 263 are directed to impinge on sample 241 by the applied electric fields. At the end of a period of time 280, the voltages applied to electrode 243 are rapidly reversed, as shown in FIG. 15, to release charge from the surface of sample 241. Simultaneously, the voltage applied to electrode 242 is increased, as shown in FIG. 15, to direct gas phase ions to move through opening 268 in nosepiece 267 against heated counter current gas flow 255. The voltage applied to electrode nosepiece 267 and/or capillary entrance electrode 251 may also be decreased to further enhance electric field 254, as shown during time period 281 in FIG. 15. Electric field 254 directs ions toward capillary entrance electrode 251 and into capillary bore 253. Alternatively, as ions approach the capillary entrance into vacuum, voltages applied to nose piece electrode 267 and capillary entrance electrode 251 can be switched so that a lower, or even no, electric field is applied between nosepiece electrode 267 and capillary entrance electrode 251 as shown during time period 282 in FIG. 15. Gas flow into bore 253 of capillary 252 sweeps ions into and through capillary bore 253. Infrared lamp 260 may be turned on to aid in the drying of droplets produced in Electrosprays 262, 263 and 264.

The voltages applied to Ring Electrodes 248, 249 and 250 may be switched synchronous to the voltage applied to electrodes 243 and 242. When the voltages applied to electrodes 243 and 242 are switched to direct ions away from the surface of sample 241, the voltages applied to ring electrodes 248, 249 and 250 may be switched to prevent the generation of charged liquid droplets, as shown in FIG. 15 during time periods 281 and 282. Ion generation from sprays 261, 262 and 263, combining in mixing region 264, may be turned off during the release of ions from the surface of sample 241, minimizing the transport of non sample related ion populations into capillary bore 253. Ions generated from ions or charged droplets impinging sample 241 then comprise the primary ion population mass to charge analyzed. Alternatively, solution flow through ES inlet probes 245, 246 and 247 can be turned off when ions are released from the surface of sample 241. If additional gas phase charge exchange reactions and/or ionization of released sample ions and molecules from sample surface 241 is desired, voltages applied to electrodes 248, 249 and 250 can be set to retain the production of Electrospray charged droplets which evaporate to form gas phase reagent ions. Voltages are applied to ES inlet probes 245, 256 and 257, ring electrodes 248, 249 and 250, electrodes 243, 242, nosepiece 267 and capillary entrance electrode 251 from power supply 256. Rapid switching of voltages during ion generation and data acquisition is controlled through controller 257 linked to power supply 256 through connection 258. The charging and release of charge from the surface of sample 241 can occur several times a second during mass spectrum acquisition using software control.

The multiple function API source embodiments described can be employed in a wide range of analytical applications to improve analytical capability and reduce analysis time and expense. Consider as an example, the MS or LC-MS analysis of a complex biological matrix, such as blood or urine, for the detection, quantification and identification of biomarkers or metabolites. After an initial cleanup step, the sample may be sprayed directly or sent through a front end one or two dimensional Liquid Chromatography step providing some degree of sample species separation prior to MS analysis. With rapid switching between operating modes, the proposed multiple function ion source can produce positive and negative Electrospray and APCI ions from polar and non polar compounds in solution. The Electrospray and APCI ion generation can occur separately in time or simultaneously. If multiply charged peptide or protein ions are produced in Electrospray mode from a primary sample solution ES inlet probe 1, selected ions of opposite polarity can be generated from solution sprayed through a second probe 2 and reacted with the multiply charged ions Electrosprayed from the probe 1. The population of opposite polarity reagent ions can be chosen to promote charge reduction reactions or Electron Transfer Dissociation reactions separately or simultaneously. Alternatively, the second inlet probe 2 can be operated to produce a neutral vapor of reagent molecules having an appropriate gas phase basicity that mix and react with the multiply charged ions generated from ES inlet probe 1 resulting in charge reduction Charge reduction reactions can occur with multiply charged positive polarity ions when negative polarity reagent ions or high proton affinity neutral molecules react with multiply charged ions and remove protons. Conversely, charge reduction reactions can occur with multiply charged negative polarity ions when positive polarity reagent ions or low proton affinity (or high electron affinity) neutral molecules react with multiply charged ions by transferring protons. Electron Transfer Dissociation reactions can occur when negative polarity reagent ions transfer an electron to a multiply charged positive polarity peptide or protein at low energy. Charge reduction allows the shifting of multiply charged peaks, increasing peak capacity, reducing interferences in the mass spectrum, and potentially increasing signal to noise by collapsing a larger number of multiply charged peaks into a fewer number of multiply charged peaks. ETD fragment ions produced in the API source can subsequently be subjected to additional MS″ fragmentation in the mass analyzer to obtain unambiguous identification of protein or peptide biomarker species in solution. Front end LC separation will reduce the number of components and hence the complexity of parent ion and fragment ion peaks per mass spectrum. This decreases the burden on evaluation software to identify and quantify components in solution resulting in increased MS analytical specificity. In clinical applications, the proposed multiple function API source configured with minimum hardware complexity, enables higher analytical specificity and decreased analysis time without compromising sensitivity and quantitative performance.

The proposed multiple function ion source may also be used to enhance MS analytical capability in high throughput compound screening. A number of analytical capabilities of the proposed multiple function API ion source can be utilized in the high throughput screening of drug candidates using pharmaceutical compound libraries. Prior to screening for a drug candidate, the reference library compound solution quality may be checked by running each sample through MS or LC-MS analysis to assess compound purity. Several hundred thousand compound library samples may be analyzed prior to a drug screening run, and it is desirable to minimize the cost per analysis per sample while maximizing analytical performance. A multiple function API source with the ability to rapidly switch between ES, APCI and APR ionization in positive and negative ion polarity modes can be used to ionize a large percentage of compound types contained in the compound library samples, providing a more complete picture of sample purity. Selectively applying different ionization modes with rapid switching between each mode while retaining quantitative response to the sample analyzed, increases the confidence of sample purity analysis at a lower cost per sample. The need to rerun samples through multiple ion sources will not be required Reference compounds that enable mass to charge calibration can be simultaneously added in the proposed ion source to provide internal calibration peaks in acquired mass spectra or mass spectra acquired close in time to the analyte MS spectra and used for external calibration. Time-Of-Flight mass spectrometric analysis routinely achieves sub 5 part per million (ppm) mass measurement accuracies with internal calibration and with external calibration acquired close in time to acquired sample mass spectra. Improved mass measurement accuracies combined with higher resolving power of TOF mass spectrometers (compared to quadrupole MS) provide a higher confidence level when assessing purity of known compounds in library samples. MS peak overlap is reduced and higher precision MS peak centroid measurement is achieved. The proposed multiple function ion source will reduce analysis time and cost for large sample lots while enhancing the quality, specificity and accuracy of sample characterization in high throughput biological screening or combinatorial chemistry applications.

What is claimed is:

1. An apparatus for generating ions comprising;

a. two Electrospray inlet probes, the two Electrospray inlet probes are arranged with opposing symmetry about an axis of the apparatus;

b. two ring electrodes each positioned proximal to an exit end of a corresponding one of the two Electrospray inlet probes so that during use of the apparatus, the two ring electrodes each shields a local electric field at the corresponding exit end from being modified by an electric field external to the exit ends;

c. means for applying voltages to the two ring electrodes to independently control the Electrospray ionization process of each of the two Electrospray inlet probes; and d. means for delivering sample solution to at least one of the at least two Electrospray inlet probes to produce sample ions in a sample solution spray.

2. An apparatus according to claim 1, further comprising at least one Atmospheric Pressure Chemical Ionization Inlet Probe.

3. An apparatus according to claim 1, further comprising a means for directing said sample ions into an orifice into vacuum.

4. An apparatus according to claim 3, further comprising a mass to charge analyzer and detector positioned downstream of said orifice into vacuum for conducting mass to charge analysis of said sample ions.

5. An apparatus according to claim 1, wherein the two ring electrodes each surrounds the corresponding exit end of the two Electrospray inlet probes.

6. An apparatus according to claim 1, wherein during use of the apparatus, voltages applied to a first one of the two ring electrodes generate negative ions from the first one of the two Electrospray inlet probes, and voltages applied to a second one of the two ring electrodes generate positive ions from the second one of the two Electrospray inlet probes, wherein the negative ions and the positive ions interact to cause charge reduction or electron transfer dissociation (ETD) of the sample ions in a sample solution spray.

7. The apparatus of claim 1, wherein during use of the apparatus, voltages are applied to the two Electrospray inlet probes and/or the two ring electrodes so that electric fields of opposite polarity are generated at the exit ends of the two Electrospray inlet probes to generate ions of opposite polarities.

8. The apparatus of claim 1, wherein the apparatus is configured to generate ions of opposite polarities simultaneously.

9. An apparatus for generating ions comprising;

a. two Electrospray inlet probes;

b. a translation stage to translate and/or a rotation mount to adjustably angle the two Electrospray inlet probes for optimizing ion transmission into a downstream capillary;

c. two ring electrodes each positioned proximal to an exit end of a corresponding one of the two Electrospray inlet probes so that during use of the apparatus, the two ring electrodes each shields a local electric field at the corresponding exit end from being modified by an electric field external to the exit ends;

d. means for applying voltages to the two ring electrodes to independently control the Electrospray ionization process of each of the two Electrospray inlet probes; and e. means for delivering sample solution to at least one of the two Electrospray inlet probes to produce sample ions in a sample solution spray.

* * * * *